US011578585B2

(12) United States Patent
Al-Huwaider et al.

(10) Patent No.: US 11,578,585 B2
(45) Date of Patent: Feb. 14, 2023

(54) FORMATION EVALUATION WITH TARGETED HEATING

(71) Applicant: Saudi Arabian Oil Company, Dhahran (SA)

(72) Inventors: Mustafa A. Al-Huwaider, Dhahran (SA); Shouxiang Mark Ma, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 298 days.

(21) Appl. No.: 16/863,740

(22) Filed: Apr. 30, 2020

(65) Prior Publication Data

US 2021/0340859 A1 Nov. 4, 2021

(51) Int. Cl.

| | |
|---|---|
| ***E21B 47/01*** | (2012.01) |
| ***E21B 49/08*** | (2006.01) |
| ***E21B 47/07*** | (2012.01) |
| ***H05B 6/64*** | (2006.01) |

(52) U.S. Cl.

CPC ..... *E21B 47/01* (2013.01); *E21B 47/07* (2020.05); *E21B 49/0875* (2020.05); *H05B 6/6452* (2013.01)

(58) Field of Classification Search

CPC .. E21B 47/01; E21B 49/0875; E21B 17/1021; E21B 36/04; E21B 49/10; E21B 47/06; H05B 6/6452

See application file for complete search history.

(56) References Cited

U.S. PATENT DOCUMENTS

| | | | | |
|---|---|---|---|---|
| 3,981,187 | A | 9/1976 | Howell | |
| 8,904,857 | B2 | 12/2014 | Tustin et al. | |
| 2008/0185142 | A1 | 8/2008 | Pelletier | |
| 2011/0005745 | A1 * | 1/2011 | Goodwin | E21B 49/10 166/250.01 |

(Continued)

FOREIGN PATENT DOCUMENTS

WO WO 2008150825 12/2008

OTHER PUBLICATIONS

Allied Horizontal Wireline Services, "Multi-arm Caliper MAC 40," retrieved from URL <https://horizontalwireline.com/wp-content/uploads/2014/09/AHWS-Multi-Arm_Caliper.pdf>, retrieved on Feb. 12, 2020, available on or before 2014, 2 pages.

(Continued)

*Primary Examiner* — Abby J Flynn
*Assistant Examiner* — Yanick A Akaragwe
(74) *Attorney, Agent, or Firm* — Fish & Richardson P.C.

(57) ABSTRACT

A wellbore tool includes a body having a longitudinal axis and an outer circumferential surface. The wellbore tool includes moveable arms, housings, actuators, a temperature sensor, a pressure sensor, and a heat source, such as a microwave source. Each moveable arm is coupled to a respective actuator and a respective housing. Each actuator is configured to move the respective moveable arm. The temperature sensor is configured to measure a temperature of the subterranean formation. The pressure sensor is configured to measure a pressure of the subterranean formation. The microwave source is configured to generate microwave radiation. Methods of analyzing acquired transient temperature and transient pressure data for formation evaluation are also described.

17 Claims, 18 Drawing Sheets

(56) References Cited

U.S. PATENT DOCUMENTS

| | | | | |
|---|---|---|---|---|
| 2012/0131996 | A1* | 5/2012 | Anish | E21B 17/1021 73/152.54 |
| 2012/0312530 | A1 | 12/2012 | Pope et al. | |
| 2013/0020128 | A1 | 1/2013 | Calleri | |
| 2019/0085687 | A1* | 3/2019 | Noui-Mehidi | E21B 47/07 |
| 2019/0129056 | A1 | 5/2019 | Rasmus et al. | |
| 2020/0003599 | A1 | 1/2020 | Theuveny et al. | |
| 2020/0088020 | A1 | 3/2020 | Batarseh et al. | |

OTHER PUBLICATIONS

Bristow et al., "Measurement of Soil Thermal Properties with a Dual-Probe Heat-Pulse Technique," Soil Sci. Soc. Am. J. 58:1288-1294, Sep. 1994, 7 pages.

glossary.oilfield.slb.com [online], "Distributed temperature log," retrieved from URL <https://www.glossary.oilfield.slb.com/en/Terms/d/distributed_temperature_log.aspx>, retrieved on Feb. 12, 2020, available on or before 2020, 1 page.

Meter Environment [online], "Thermal Properties: Why the TEMPOS method outperforms other techniques," retrieved from URL <https://www.metergroup.com/environment/articles/thermal-properties-transient-methodoutperforms-techniques/>, retrieved on Feb. 12, 2020, avaiable on or before 2020, 6 pages.

Mohamed et al., "Leak Detection by Temperature and Noise Logging," Society of Petroleum Engineers, Abu Dhabi International Petroleum Conference and Exhibition, Nov. 11-14, 2012, Abu Dhabi, UAE, abstract retrieved from URL <https://archive.is/20130628032024/http://www.onepetro.org/mslib/servlet/onepetropreview#selection-191.0-191.96>, retrieved on Feb. 12, 2020, 2 pages, Abstract Only.

Schlumberger, "PS Platform, Production services platform," retrieved from URL <https://www.slb.com/-/media/files/production/product-sheet/ps_platform_ps.ashx>, retrieved on Feb. 12, 2020, available on or before 2014, 3 pages.

PCT International Search Report and Written Opinion in International Appln. No. PCT/US2021/029896, dated Aug. 10, 2021, 16 pages.

* cited by examiner

FORMATION EVALUATION WITH TARGETED HEATING

TECHNICAL FIELD

This disclosure relates to characterization of subterranean formations.

BACKGROUND

Commercial-scale hydrocarbon production from conventional reservoirs and source rocks requires significant capital. It is therefore beneficial to obtain as much accurate data as possible about a formation in order to assess its commercial viability and subsequently, to optimize cost and design of development. Data can be collected before production, such as during drilling and logging applications, and during production. Hydrocarbon assessment can be used to predict production, estimate reserves, and evaluate quality of conventional reservoirs and source rocks. Reservoir characterization and monitoring can aid in preventive action, so that potential or impending problems can be mitigated or prevented proactively in contrast to dealing with problems reactively, after process disruptions have already occurred. Exploration and reservoir management are a few of the many areas that can benefit from comprehensive formation evaluation and reservoir performance monitoring.

SUMMARY

This disclosure describes technologies relating to characterization of subterranean formations and fluids disposed within the same. Certain aspects of the subject matter can be implemented as a wellbore tool. The wellbore tool includes a body, multiple moveable arms, multiple housings, multiple actuators, a temperature sensor, a pressure sensor, and a heat source, such as a microwave source or electrical heat source. The body has a longitudinal axis and an outer circumferential surface. The body is configured to be disposed within a wellbore formed in a subterranean formation. At least a portion of each of the moveable arms is positioned within the body. Each housing is positioned external to the body and coupled to a respective moveable arm. Each actuator is positioned within the body and coupled to a respective moveable arm. Each actuator is configured to move the respective moveable arm. The body defines multiple openings on the outer circumferential surface of the body. Each moveable arm is configured to move through a respective opening in response to being moved by the respective actuator. The temperature sensor is disposed on an outer surface of one of the housings. The temperature sensor is configured to measure a temperature of the subterranean formation. The pressure sensor is disposed on an outer surface of one of the housings. The pressure sensor is configured to measure a pressure of the subterranean formation. The heat source (for example, the microwave source) is disposed on an outer surface of one of the housings. In cases where the heat source includes a microwave source, the microwave source is configured to generate microwave radiation.

This, and other aspects, can include one or more of the following features.

The wellbore tool can include a computer positioned within the body. The computer can be configured to communicate with the temperature sensor, the pressure sensor, and the microwave source. The computer can include a processor and a computer-readable medium storing instructions executable by the processor to perform operations. The operations can include sending a signal to a first actuator to initiate movement of the respective moveable arm to which the first actuator is coupled. The operations can include receiving temperature data from the temperature sensor. The operations can include receiving pressure data from the pressure sensor. The operations can include transmitting the received temperature data, the received pressure data, or both of the received temperature data and the received pressure data to a surface location via a wireline coupled to the body.

Each moveable arm can be segmented into a first segment, a second segment, and a third segment. Each moveable arm can include a first joint, a second joint, and a third joint. The first joint can couple the first segment and the second segment. The first segment can be coupled to a respective actuator. The second joint can couple the second segment, the third segment, and a respective housing. The third joint can couple the third segment and the body. The third joint can be fixed in location relative to the body.

Each actuator can be configured to move the first segment of the respective moveable arm in a direction parallel to the longitudinal axis of the body. In response to the first segment moving in the direction parallel to the longitudinal axis of the body, the second segment, the third segment, the first joint, the second joint, and the third joint can be cooperatively configured to move the respective housing in a direction perpendicular to the longitudinal axis of the body.

The temperature sensor and the pressure sensor can be disposed on the same housing.

The temperature sensor can be configured to contact a wall of the wellbore and measure a force exerted by the wall of the wellbore onto the temperature sensor during contact. The pressure sensor can be configured to contact the wall of the wellbore and measure a force exerted by the wall of the wellbore onto the pressure sensor during contact. The microwave source can be configured to contact the wall of the wellbore and measure a force exerted by the wall of the wellbore onto the microwave source during contact.

The temperature sensor can be one of multiple temperature sensors, and each temperature sensor can be disposed on a different housing.

The pressure sensor can be one of multiple pressure sensors, and each pressure sensor can be disposed on a different housing.

The temperature sensor, the pressure sensor, and the microwave source can be disposed on the same housing.

Certain aspects of the subject matter can be implemented as a method. A temperature sensor is radially extended from a body of a wellbore tool disposed within a wellbore formed in a subterranean formation. A wall of the wellbore is contacted with the temperature sensor. A temperature of the subterranean formation is measured by the temperature sensor. A pressure of the subterranean formation is measured by a pressure sensor of the wellbore tool. A microwave source is radially extended from the body of the wellbore tool. The wall of the wellbore is contacted with the microwave source. Microwave radiation is generated by the microwave source within the wellbore. Data corresponding to the measured temperature, the measured pressure, or both the measured temperature and the measured pressure is transmitted to a surface location external to the wellbore.

This, and other aspects, can include one or more of the following features.

The body of the wellbore tool can be centralized within the wellbore by radially extending multiple temperature sensors and multiple pressure sensors from the body of the wellbore tool and contacting the wall of the wellbore with the temperature sensors and the pressure sensors.

Generating microwave radiation can occur after contacting the wall of the wellbore with the microwave source. Generating microwave radiation by the microwave source can occur until the measured temperature is substantially equal to a threshold temperature, after which generating microwave radiation ceases.

Measuring the temperature of the subterranean formation can continue during generation of microwave radiation and for a time period after the generation of microwave radiation ceases.

Measuring the pressure of the subterranean formation can continue during generation of microwave radiation and for the time period after the generation of microwave radiation ceases.

Certain aspects of the subject matter can be implemented as a computer-implemented method. A temperature data point is received from a temperature sensor disposed within a wellbore formed in a subterranean formation. A pressure data point is received from a pressure sensor disposed within the wellbore. A force data point is received from the temperature sensor. It is determined whether the temperature sensor is in contact with a wall of the wellbore based on the force data point received from the temperature sensor. A force data point is received from the pressure sensor. It is determined whether the pressure sensor is in contact with a wall of the wellbore based on the force data point received from the pressure sensor. A force data point is received from a microwave source disposed within the wellbore. It is determined whether the microwave source is in contact with the wall of the wellbore based on the force data point received from the microwave source. A start signal is sent to the microwave source to begin generation microwave radiation after determining that the microwave source is in contact with the wall of the wellbore. A stop signal is sent to the microwave source to cease generating microwave radiation after determining that a temperature measured by the temperature sensor is substantially equal to a threshold temperature based on the received temperature data point. The received temperature data, the received pressure data point, or both of the received temperature data point and the received pressure data point are transmitted to a surface location external to the wellbore.

This, and other aspects, can include one or more of the following features.

The received temperature data point and the received pressure data point can be linked to a time point. The steps of receiving temperature data, receiving pressure data, and linking the received temperature data point and the received pressure data point to the time point can be repeated to generate a set of transient temperature data and a set of transient pressure data. The set of transient temperature data, the set of transient pressure data, or both sets of transient temperature data and transient pressure data can be transmitted to the surface location external to the wellbore.

At least one of a fluid composition, fluid density, fluid phase tortuosity, thermal conductivity, diffusivity, heat capacity, water saturation, water salinity, wettability, or permeability of the subterranean formation can be determined based on the set of transient temperature data, the set of transient pressure data, or both sets of transient temperature data and transient pressure data.

An extend signal can be sent to an actuator coupled to a moveable arm coupled to a housing, thereby causing the actuator to extend the moveable arm to initiate contact between the housing and the wall of the wellbore. The temperature sensor, the pressure sensor, and the microwave source can be disposed on an outer surface of the housing.

A retract signal can be sent to the actuator, thereby causing the actuator to retract the moveable arm to release contact between the housing and the well of the wellbore.

The details of one or more implementations of the subject matter of this disclosure are set forth in the accompanying drawings and the description. Other features, aspects, and advantages of the subject matter will become apparent from the description, the drawings, and the claims.

DESCRIPTION OF DRAWINGS

FIG. 2A-1 is a schematic diagram of the formation evaluation tool of FIG. 1.

FIG. 2A-2 is a schematic diagram of a portion of the formation evaluation tool of FIG. 1.

FIG. 2A-3 is a schematic diagram of another portion of the formation evaluation tool of FIG. 1.

FIG. 2B-1 is a schematic diagram showing internal components of the formation evaluation tool in retracted positions.

FIG. 2B-2 is a top view and a side view of the formation evaluation tool with its moveable arms in retracted positions.

FIG. 2C-1 is a schematic diagram showing internal components of the formation evaluation tool in extended positions.

FIG. 2C-2 is a top view and a side view of the formation evaluation tool with its moveable arms in extended positions.

FIG. 3 is a flow chart of an example method for formation evaluation and reservoir characterization by using targeted heating in the well of FIG. 1.

DETAILED DESCRIPTION

This disclosure relates to characterization of subterranean formations and fluids disposed within the same. A formation evaluation (FE) tool includes sensors (such as temperature sensors and pressure sensors) and a heating source (such as a microwave source). The FE tool can be disposed within a wellbore formed in a subterranean formation. Each of the sensors and the heating source can extend radially to contact a wall of the wellbore. The extending capability of these components allows them to function as centralizers to centralize the FE tool and also as calipers for characterizing wellbore size and shape. Once the FE tool is positioned at a desired location within the wellbore, the microwave source generates microwave radiation. The generated microwave radiation induces rotation in polar molecules present in the subterranean formation (for example, water), which produces thermal energy in a process known as dielectric heating. In some implementations, once a desired temperature is reached, the microwave source is turned off. Data (such as temperature and pressure data) are collected during this process and also for a time period after the microwave source is turned off. The transient temperature and pressure data can be processed to determine one or more properties of the subterranean formation, such as fluid composition and density (water, hydrocarbon, or both), fluid phase tortuosity, thermal conductivity, water saturation, water salinity, wettability, and permeability (such as vertical, horizontal, and diagonal permeability).

The subject matter described in this disclosure can be implemented in particular implementations, so as to realize one or more of the following advantages. The FE tool can allow for quick and non-invasive measurements that can be used for in situ formation characterization. Observing transient behavior (for example, transient temperature behavior) of the subterranean formation can shed light on various properties of both the formation itself and the fluids contained within the formation. Multiple properties can be determined based on a single set of transient temperature data. The FE tool can be used multiple times at varying depths within the wellbore, which can allow for a comprehensive evaluation of the subterranean formation. Transient temperature measurements and analysis can be combined with transient pressure measurements and analysis along with other formation evaluation measurements for a more comprehensive characterization of subterranean formations.

Figure 1:
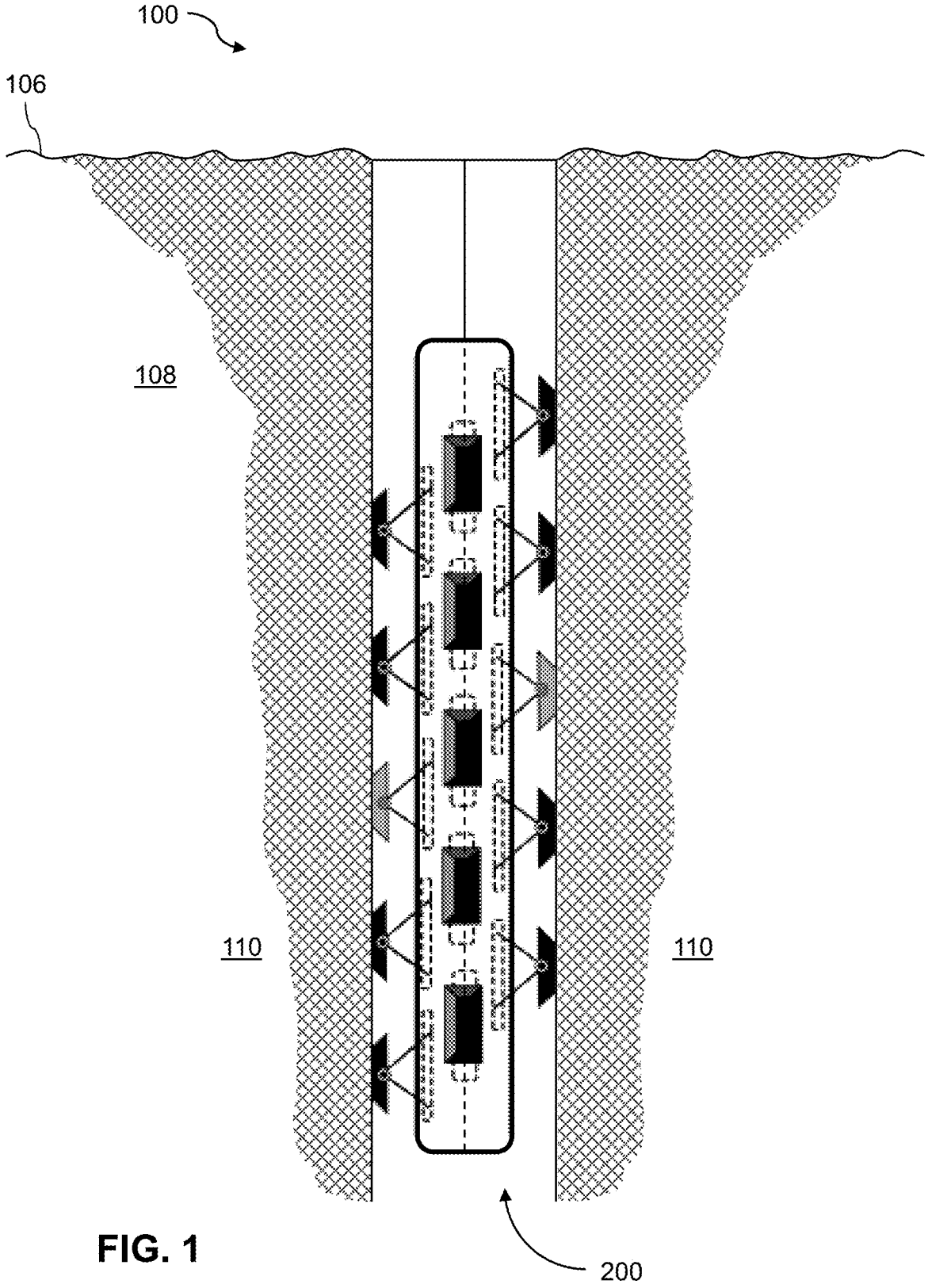
FIG. 1 is a schematic diagram of an example formation evaluation tool disposed within a well.

FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover hydrocarbons. In some implementations, the subterranean zone includes an underground formation of naturally fractured or porous rock containing hydrocarbons (for example, oil, gas, or both). In some implementations, the well can intersect other suitable types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, observation wells, or other types of wells used in placing fluids into the Earth.

The wellbore of the well 100 is typically, although not necessarily, cylindrical. All or a portion of the wellbore is lined with a tubing, such as casing. In some implementations, the casing is omitted or ceases in the region of the subterranean zone of interest 110. This portion of the well 100 without casing is often referred to as "open hole."

The well 100 can include a wellhead (not shown) that defines an attachment point for other equipment to be attached to the well 100. The well 100 can include a FE tool 200 residing in the wellbore, for example, at a depth that is nearer to subterranean zone 110 than the surface 106. The FE tool 200 is of a type configured in size and robust construction for installation within a well 100. The FE tool 200 can be made to fit in and, in certain instances, seal to a wall of the well 100 (for example, the wellbore wall).

Additionally, the construction of the components of the FE tool 200 are configured to withstand the impacts, scraping, and other physical challenges the FE tool 200 will encounter while being passed hundreds of feet/meters or even multiple miles/kilometers into and out of the well 100. For example, the FE tool 200 can be disposed in the well 100 at a depth of up to 20,000 feet (6,096 meters). Beyond just a rugged exterior, this encompasses having certain portions of any electronics being ruggedized to be shock resistant and remain fluid tight during such physical challenges and during operation. Additionally, the FE tool 200 is configured to withstand and operate for extended periods of time at the pressures and temperatures experienced in the well 100, which temperatures can exceed 400 degrees Fahrenheit (° F.)/205 degrees Celsius (° C.) and pressures over 2,000 pounds per square inch gauge (psig), and while submerged in the well fluids (gas, water, or oil as examples). Finally, the FE tool 200 can be configured to interface with one or more of the common deployment systems, such as coiled tubing (that is, not-jointed tubing, but rather a continuous, unbroken and flexible tubing formed as a single piece of material), or wireline with an electrical conductor (that is, a monofilament or multifilament wire rope with one or more electrical conductors, sometimes called e-line) and thus have a corresponding connector (for example, a jointed tubing connector, coiled tubing connector, or wireline connector).

The FE tool 200 can operate in a variety of downhole conditions of the well 100. For example, the initial pressure within the well 100 can vary based on the type of well, depth of the well 100. In some examples, the pressure in the well 100 proximate a bottomhole location is much higher than atmospheric, where the pressure in the well 100 is above about 14.7 pounds per square inch absolute (psia), or about 101.3 kiloPascal (kPa). The FE tool 200 can operate in above atmospheric well pressures, for example, at well pressure between 14.7 psia (101.3 kPa) and 5,000 psia (34,474 kPa).

Figures 1, 2A:
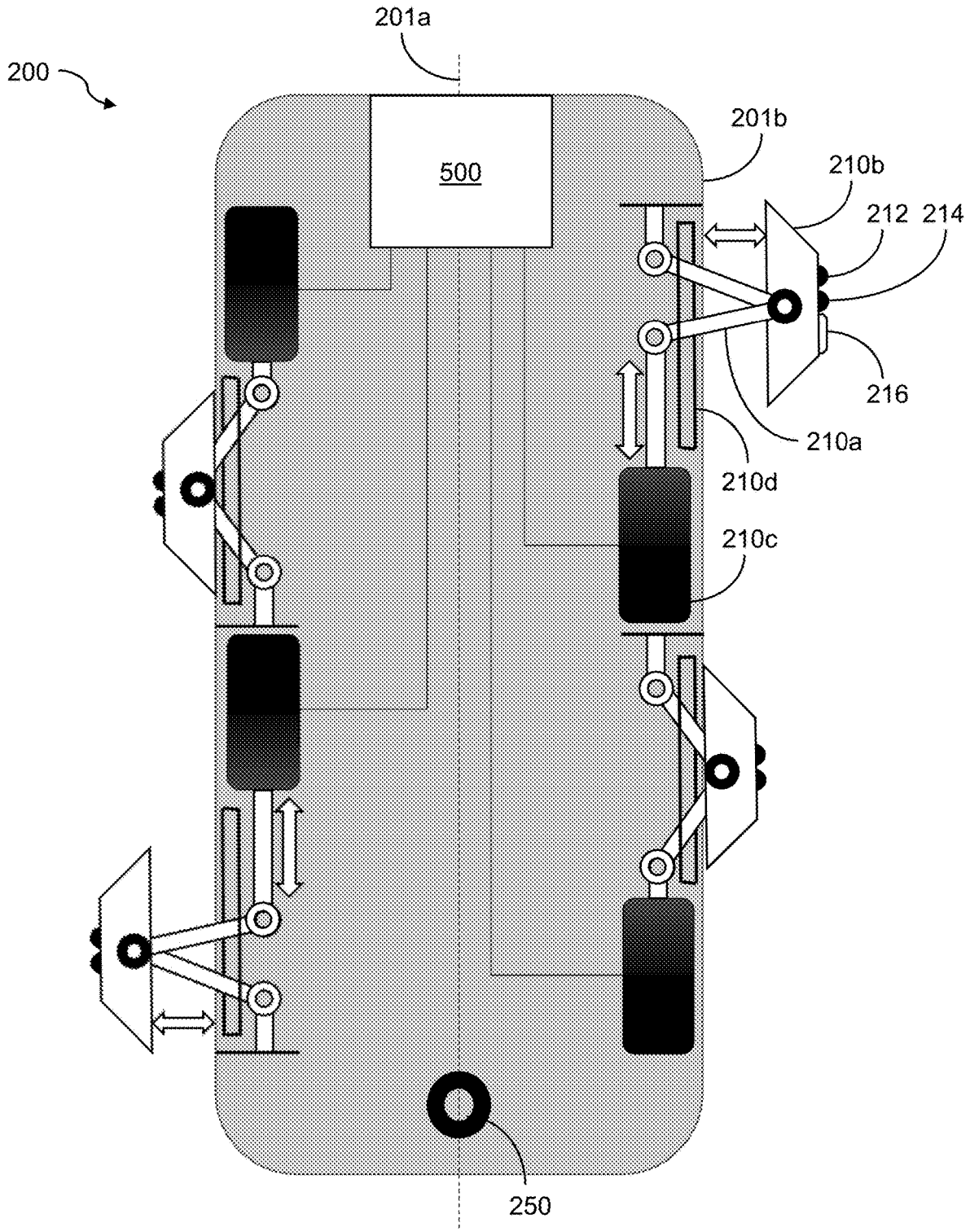

FIG. 2A-1 is a schematic diagram of an implementation of the FE tool 200 that can be disposed within the well 100 of FIG. 1. The FE tool 200 is a wellbore tool in that it is to be disposed within a wellbore (for example, the wellbore of the well 100) and used within the wellbore. The FE tool 200 includes a body having a longitudinal axis 201*a* and an outer circumferential surface 201*b*. The body is configured to be disposed within the wellbore.

The FE tool 200 includes multiple moveable arms 210*a*. At least a portion of each moveable arm 210*a* is positioned within the body of the FE tool 200. The FE tool 200 includes multiple housings 210*b*. Each housing 210*b* is positioned external to the body of the FE tool 200. Each housing 210*b* is coupled to a respective one of the moveable arms 210*a*. The FE tool 200 includes multiple actuators 210*c*. Each actuator 210*c* is positioned within the body of the FE tool 200. Each actuator 210*c* is coupled to a respective one of the moveable arms 210*a* and is configured to move the respective moveable arm 210*a*. The body of the FE tool 200 defines multiple openings 210*d* on its outer circumferential surface 201*b*. Each moveable arm 210*a* is configured to move through a respective one of the openings 210*d* in response to being moved by the respective actuator 210*c*. The moveable arms 210*a*, housings 210*b*, and actuators 210*c* are described in more detail later.

The FE tool 200 includes a temperature sensor 212, a pressure sensor 214, and a heat source 216. The temperature sensor 212 is disposed on an outer surface of one of the housings 210*b*. The pressure sensor 214 is disposed on an outer surface of one of the housings 210*b*. The heat source 216 is disposed on an outer surface of one of the housings 210*b*. In some implementations, the FE tool 200 includes multiple temperature sensors 212, and each temperature sensor 212 is disposed on a different one of the housings 210*b*. In some implementations, the FE tool 200 includes multiple pressure sensors 214, and each pressure sensor 214 is disposed on a different one of the housings 210*b*. In some implementations, the FE tool 200 includes multiple heat sources 216, and each heat source 216 is disposed on a different one of the housings 210*b*. Any combination of the temperature sensor 212, the pressure sensor 214, and the heat source 216 can be disposed on any one of the housings 210*b*. For example, a temperature sensor 212 and a pressure sensor 214 can be disposed on one or more of the housings 210*b*. For example, a temperature sensor 212, a pressure sensor 214, and a heat source 216 can be disposed on one or more of the housings 210*b*.

The temperature sensor 212 is configured to measure temperature. For example, the temperature sensor 212 is configured to measure temperature within the wellbore. For example, the temperature sensor 212 is configured to measure temperature of the subterranean formation. For example, the temperature sensor is configured to measure a temperature of a region of the subterranean formation near the wellbore. In some implementations, the temperature sensor 212 is configured to detect changes in temperature with a response time of less than 1 second. In some implementations, the temperature sensor 212 is configured to measure temperature with an accuracy of within 2 degrees Fahrenheit (° F.), within 1° F., within 0.5° F., within 0.2° F., or within 0.1° F. In some implementations, the temperature sensor 212 provides temperature measurements with a resolution of 0.01° F. or 0.005° F. In some implementations, the temperature sensor 212 is configured to contact a wall of the wellbore and measure a force exerted by the wall of the wellbore onto the temperature sensor 212 during contact.

The pressure sensor 214 is configured to measure a pressure. For example, the pressure sensor 214 is configured to measure a pressure within the wellbore. For example, the pressure sensor 214 is configured to measure a pressure within the subterranean formation. In some implementations, the pressure sensor 214 is configured to detect changes in pressure with a response time of less than 1 second. In some implementations, the pressure sensor 214 is configured to measure pressure within the wellbore with an accuracy of within 5 pounds per square inch (psi), within 4 psi, within 3 psi, within 2 psi, or within 1 psi. In some implementations, the pressure sensor 214 provides pressure measurements with a resolution of 0.1 psi, 0.05 psi, or 0.01 psi. In some implementations, the pressure sensor 214 is configured to contact a wall of the wellbore and measure a force exerted by the wall of the wellbore onto the pressure sensor 214 during contact. The pressure sensor 214 can include substantially the same features as the temperature sensor 212 for measuring force during contact with the wellbore wall.

The heat source 216 is configured to generate heat. For example, the heat source 216 can include a microwave source or an electric heater. In some implementations, the heat source 216 is a microwave source 216 that generates microwave radiation. In some implementations, the microwave source 216 is configured to contact a wall of the wellbore and measure a force exerted by the wall of the wellbore onto the heat source 216 during contact. The microwave source 216 can include substantially the same features as the temperature sensor 212 and the pressure sensor 214 for measuring force during contact with the wellbore wall.

The actuators 210*c* can extend the moveable arms 210*a* radially far enough from the body of the FE tool 200, such that the outer surfaces of the housings 210*b* (and in turn, the temperature sensor(s) 210*b*, the pressure sensor(s) 220*b*, and the microwave source(s) 230*b*) are in contact with the wellbore wall. In this way, the moveable arms 210*a*, the housings 210*b*, and the actuators 210*c* can work together to provide centralizing functionality to the FE tool 200 (that is, centering the FE tool 200 within the wellbore).

In some implementations, the FE tool 200 includes a computer 500 that is positioned within the body of the FE tool 200. The computer 500 is configured to communicate with the temperature sensor(s) 212, the pressure sensor(s) 214, and the microwave source(s) 216. In some implementations, the computer 500 wirelessly communicates with the temperature sensor(s) 212, the pressure sensor(s) 214, and the microwave source(s) 216. In some implementations, the computer 500 is physically connected to the temperature sensor(s) 212, the pressure sensor(s) 214, and the microwave source(s) 216, for example, by wires, and the computer 500 communicates to the temperature sensor(s) 212, the pressure sensor(s) 214, and the microwave source(s) 216 through the wired connections.

The computer 500 includes a processor and a computer-readable medium that stores instructions executable by the processor to perform various operations. The various operations include sending a signal to at least one of the actuators 210*c* to initiate movement of the respective moveable arm

210*a*. The various operations include receiving temperature data from the temperature sensor(s) 212. The various operations include receiving pressure data from the pressure sensor(s) 214. The various operations include transmitting the received temperature data, the received pressure data, or both of the received temperature data and the received pressure data to a surface location (106), for example, via a wireline coupled to the body of the FE tool 200. The computer 500 is shown in more detail in FIG. 5 and is also described in more detail later.

In some implementations, the FE tool 200 does not include the computer 500. In such implementations, the FE tool 200 is controlled by an external computer located at the surface 106 (external to the wellbore) that is connected to the FE tool 200, for example, by a wireline.

In some implementations, the FE tool 200 includes a borehole fluid sensor 250. The borehole fluid sensor 250 can include a borehole fluid temperature sensor and a borehole fluid pressure sensor. While the temperature sensor(s) 212 and pressure sensor(s) 214 are configured to contact the wellbore wall and measure temperature and pressure, respectively, of a region of the subterranean formation near the wellbore, the borehole fluid temperature sensor and the borehole fluid pressure sensor of the borehole fluid sensor 250 measure the temperature and pressure of the fluid residing within the wellbore. Although shown in FIG. 2A-1 as including one borehole fluid sensor 250, the FE tool 200 can include multiple borehole fluid sensors 250.

Figures 2, 2A:
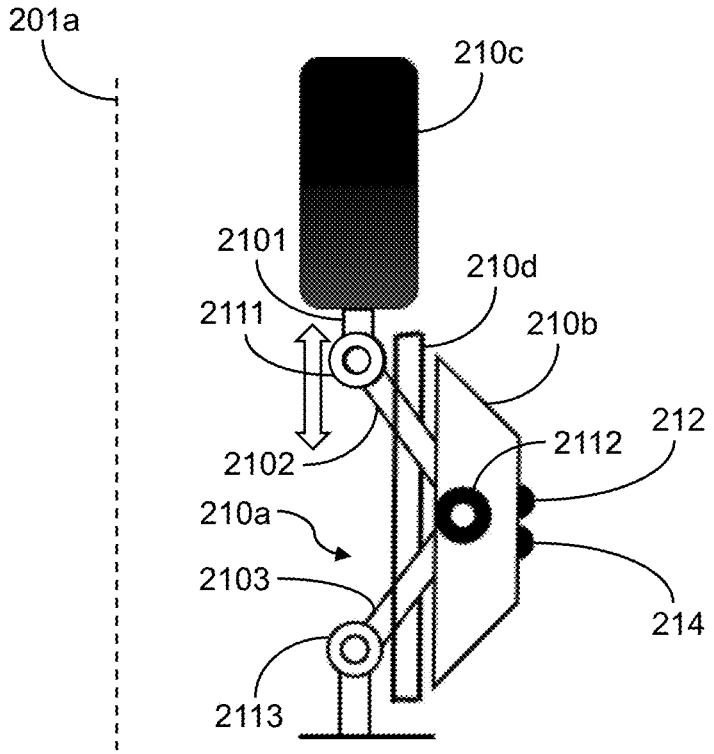

FIG. 2A-2 illustrates an example of one of the moveable arms 210*a* in a retracted position. In this particular example, a temperature sensor 212 and a pressure sensor 214 are disposed on the outer surface of the housing 210*b*. In some implementations, each moveable arm 210*a* is segmented into a first segment 2101, a second segment 2102, and a third segment 2103. In such implementations, each moveable arm 210*a* includes a first joint 2111, a second joint 2112, and a third joint 2113. The first joint 2111 couples the first segment 2101 and the second segment 2102. The first segment 2101 is coupled to the respective actuator 210*c* to which the moveable arm 210*a* is coupled. The first segment 2101 and the second segment 2102 can bend toward each other or away from each other at the first joint 2111. The second joint 2112 couples the second segment 2102, the third segment 2103, and the respective housing 210*b* to which the moveable arm 210*a* is coupled. The second segment 2102 and the third segment 2103 can bend toward each other or away from each other at the second joint 2112. The third joint 2113 couples the third segment 2103 and the body of the FE tool 200. The third joint 2113 is fixed in location relative to the body of the FE tool 200. The third segment 2103 can rotate (pivot) at the third joint 2113.

The actuator 210*c* is configured to move the moveable arm 210*a*. In some implementations, the actuator 210*c* is configured to move the first segment 2101 in a direction parallel to the longitudinal axis 201*a* of the FE tool 200. For example, in the orientation shown in FIG. 2A-2, the actuator 210*c* can move the first segment 2101 downward, and the joints (2111, 2112) and segments (2102, 2013) of the moveable arm 210*a* move in conjunction to extend the housing 210*b* radially away from the body of the FE tool 200. Because the third joint 2113 is fixed in position, the downward movement of the first segment 2101 causes the second and third segments 2102 and 2103 to move through the opening 210*d*, thereby extending the housing 210*b* radially outward from the body of the FE tool 200. The actuator 210*c* can then move the first segment 2101 upward, and the joints (2111, 2112) and segments (2102, 2103) of the moveable arm 210*a* move in conjunction to retract the housing 210*b* back towards the body of the FE tool 200. Because the third joint 2113 is fixed in position, the upward movement of the first segment 2101 causes the second and third segments 2102 and 2103 to move through the opening 210*d*, thereby retracting the housing 210*b* back towards the body of the FE tool 200. In some implementations, the actuator 210*c* is a pneumatic actuator. In some implementations, the actuator 210*c* is a mechanical actuator. In some implementations, the actuator 210*c* is a magnetic actuator.

Figures 2, 2A, 3:
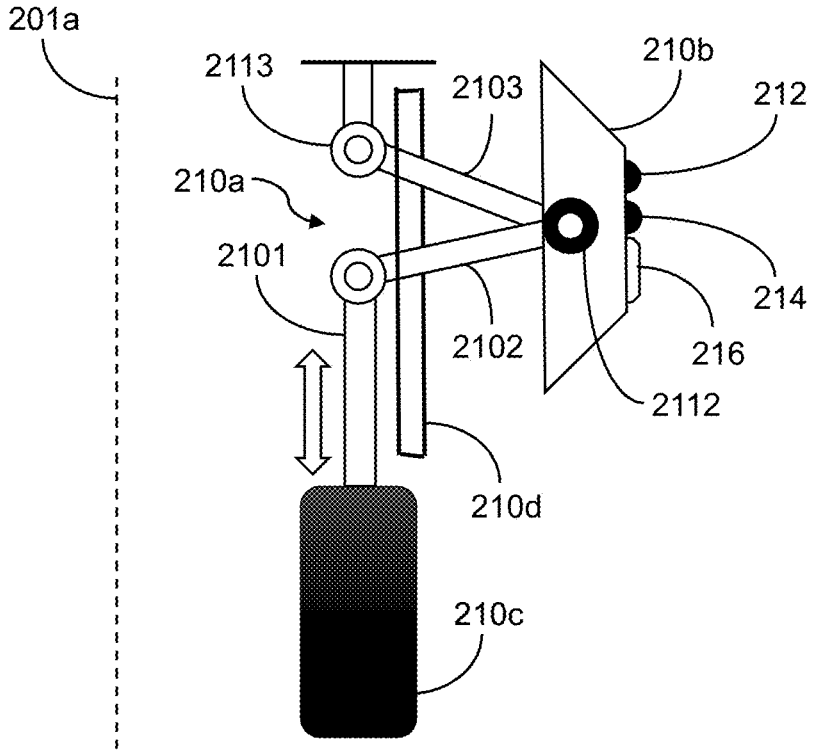

FIG. 2A-3 illustrates an example of one of the moveable arms 210*a* in an extended position. In this particular example, a temperature sensor 212, a pressure sensor 214, and a microwave source 216 are disposed on the outer surface of the housing 210*b*. In the orientation shown in FIG. 2A-3, the actuator 210*c* can move the first segment 2101 downward, and the joints (2111, 2112) and segments (2102, 2013) of the moveable arm 210*a* move in conjunction to retract the housing 210*b* towards the body of the FE tool 200. Because the third joint 2113 is fixed in position, the downward movement of the first segment 2101 causes the second and third segments 2102 and 2103 to move through the opening 210*d*, thereby retracting the housing 210*b* towards the body of the FE tool 200. The actuator 210*c* can then move the first segment 2101 upward, and the joints (2111, 2112) and segments (2102, 2103) of the moveable arm 210*a* move in conjunction to re-extend the housing 210*b* radially away from the body of the FE tool 200. Because the third joint 2113 is fixed in position, the upward movement of the first segment 2101 causes the second and third segments 2102 and 2103 to move through the opening 210*d*, thereby re-extending the housing 210*b* radially outward from the body of the FE tool 200.

Figures 1, 2B:
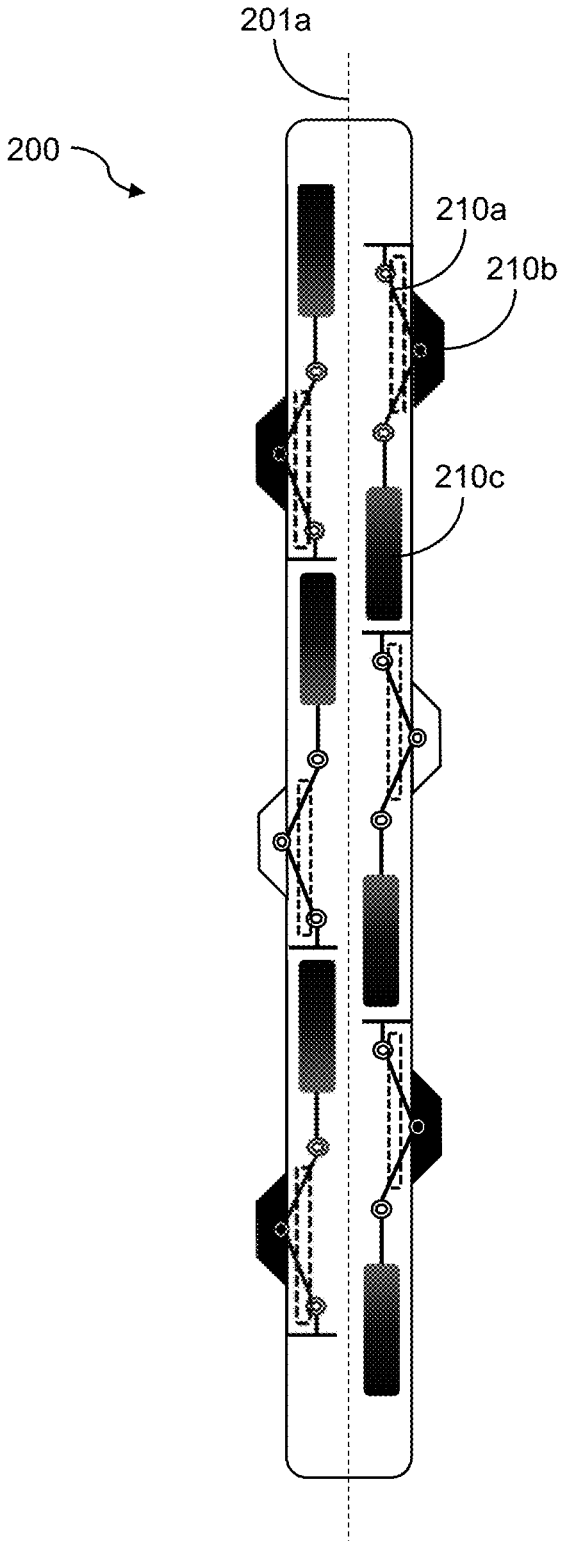
Figures 2, 2B:
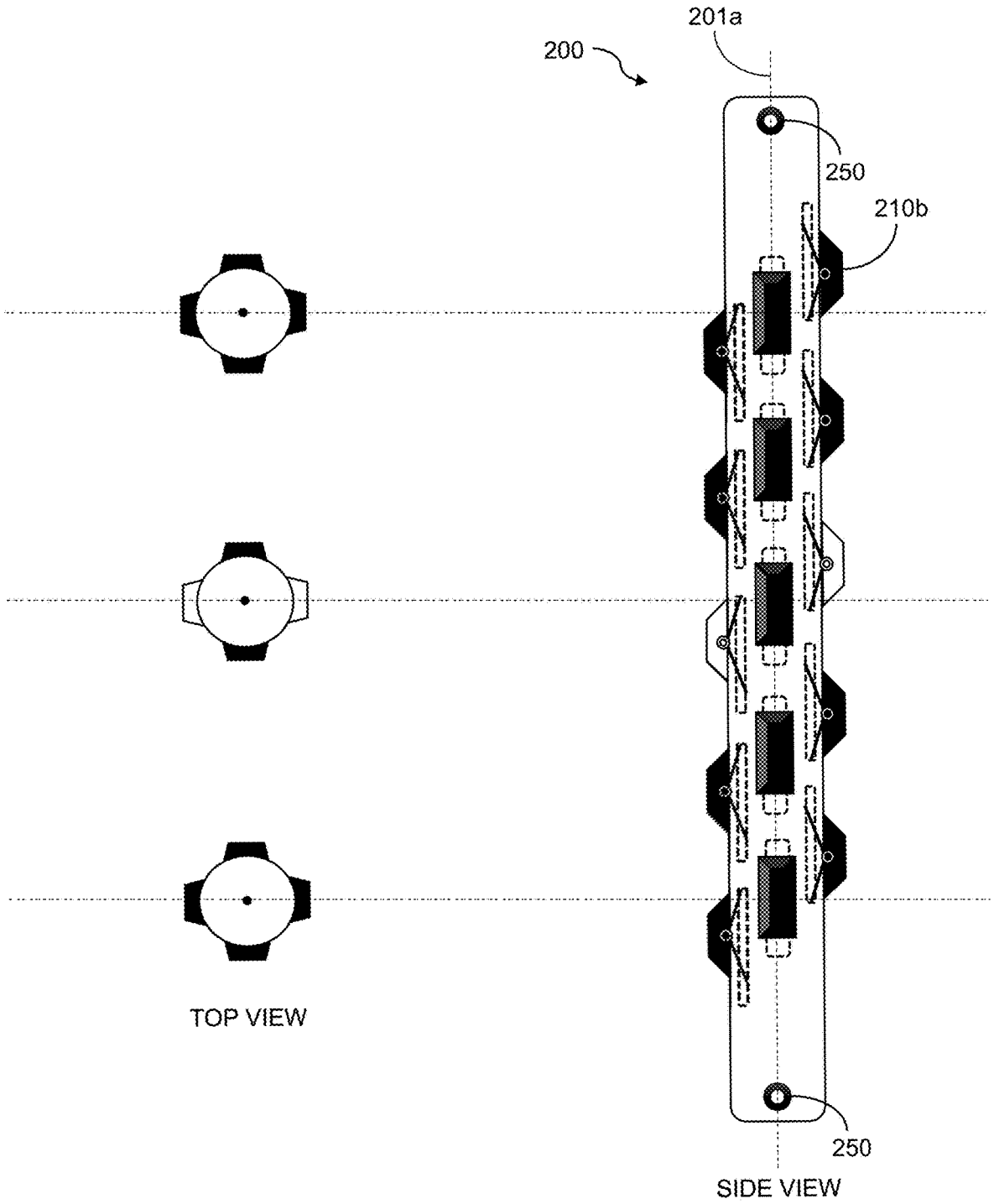

FIG. 2B-1 is a schematic diagram that shows a cross-section of the FE tool 200 with its moveable arms 210*a* in retracted positions. In this configuration, the housings 210*b* are not in contact with the wall of the wellbore. FIG. 2B-2 shows various top views and a side view of the FE tool 200 of FIG. 2B-1 with its moveable arms 210*a* in retracted positions.

Figures 1, 2C:
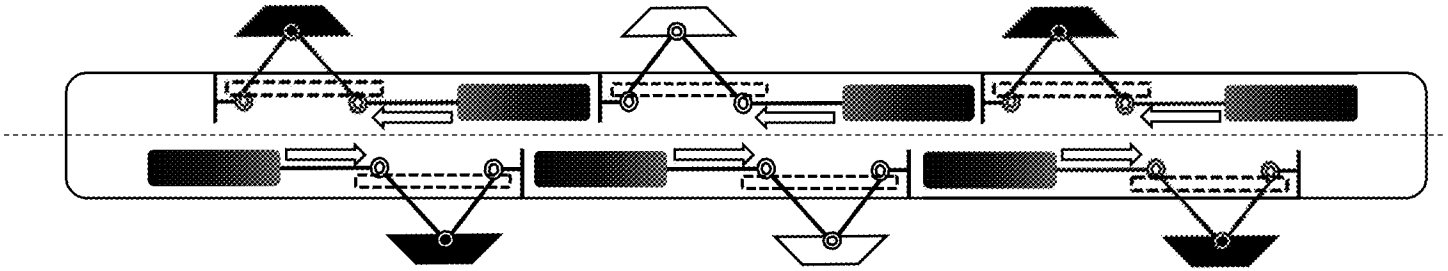
Figures 2, 2C:
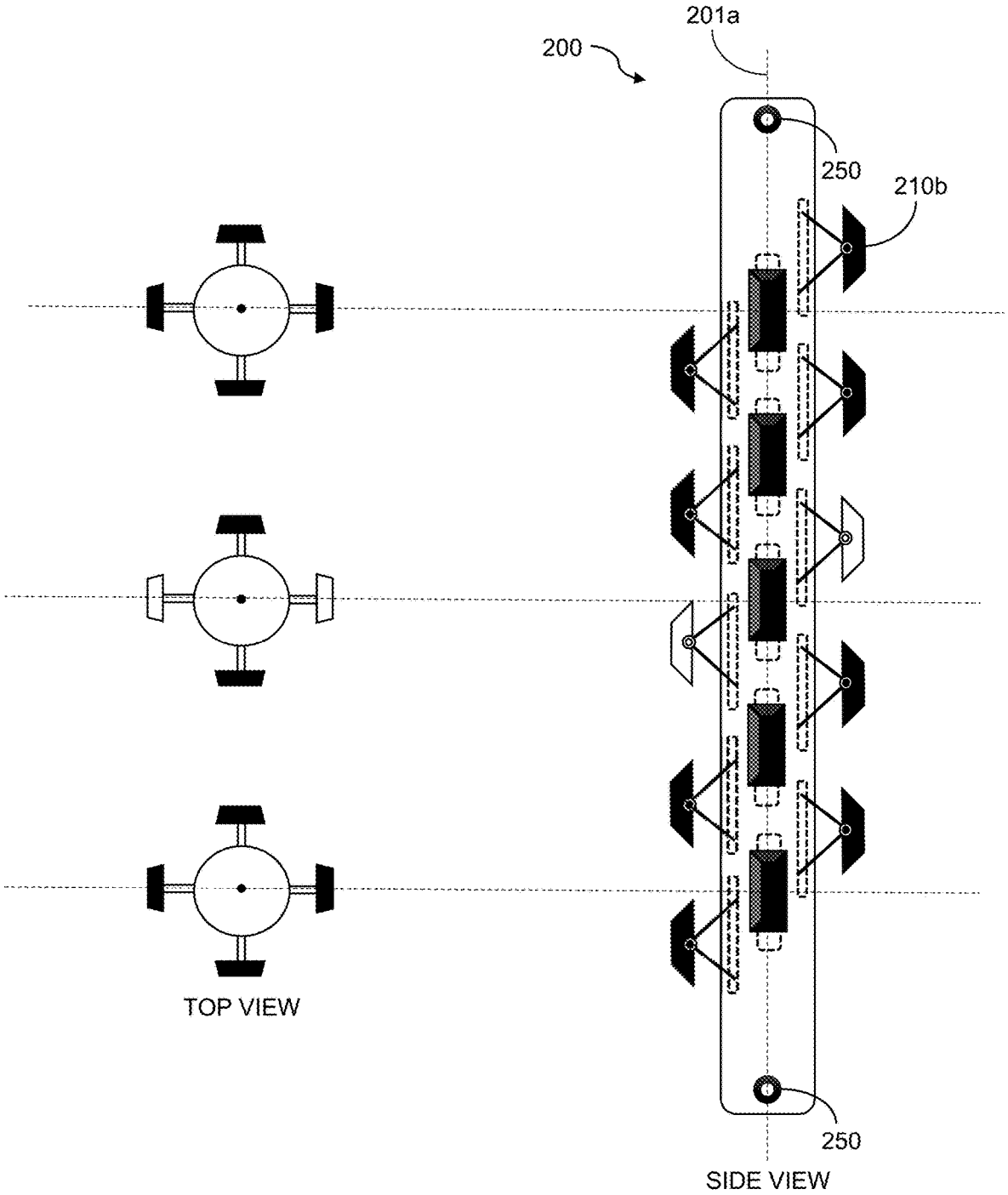

FIG. 2C-1 is a schematic diagram that shows a cross-section of the FE tool 200 with its moveable arms 210*a* in extended positions. In this configuration, the housings 210*b* are in contact with the wall of the wellbore. FIG. 2C-2 shows various top views and a side view of the FE tool 200 of FIG. 2C-1 with its moveable arms 210*a* in extended positions.

Figure 2D:
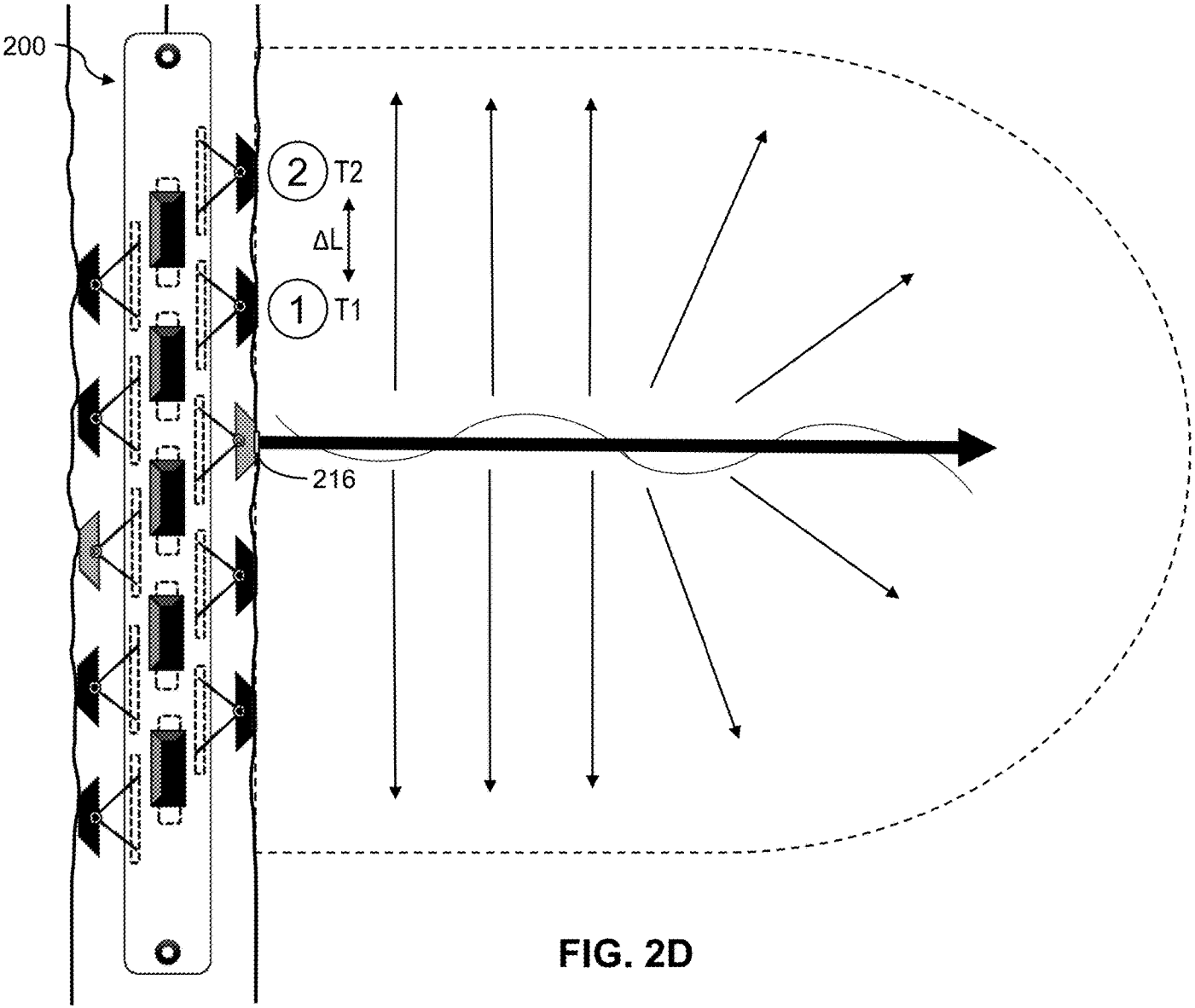
FIG. 2D is a schematic diagram of an example of the formation evaluation tool generating microwave energy within a well.
Figure 3:
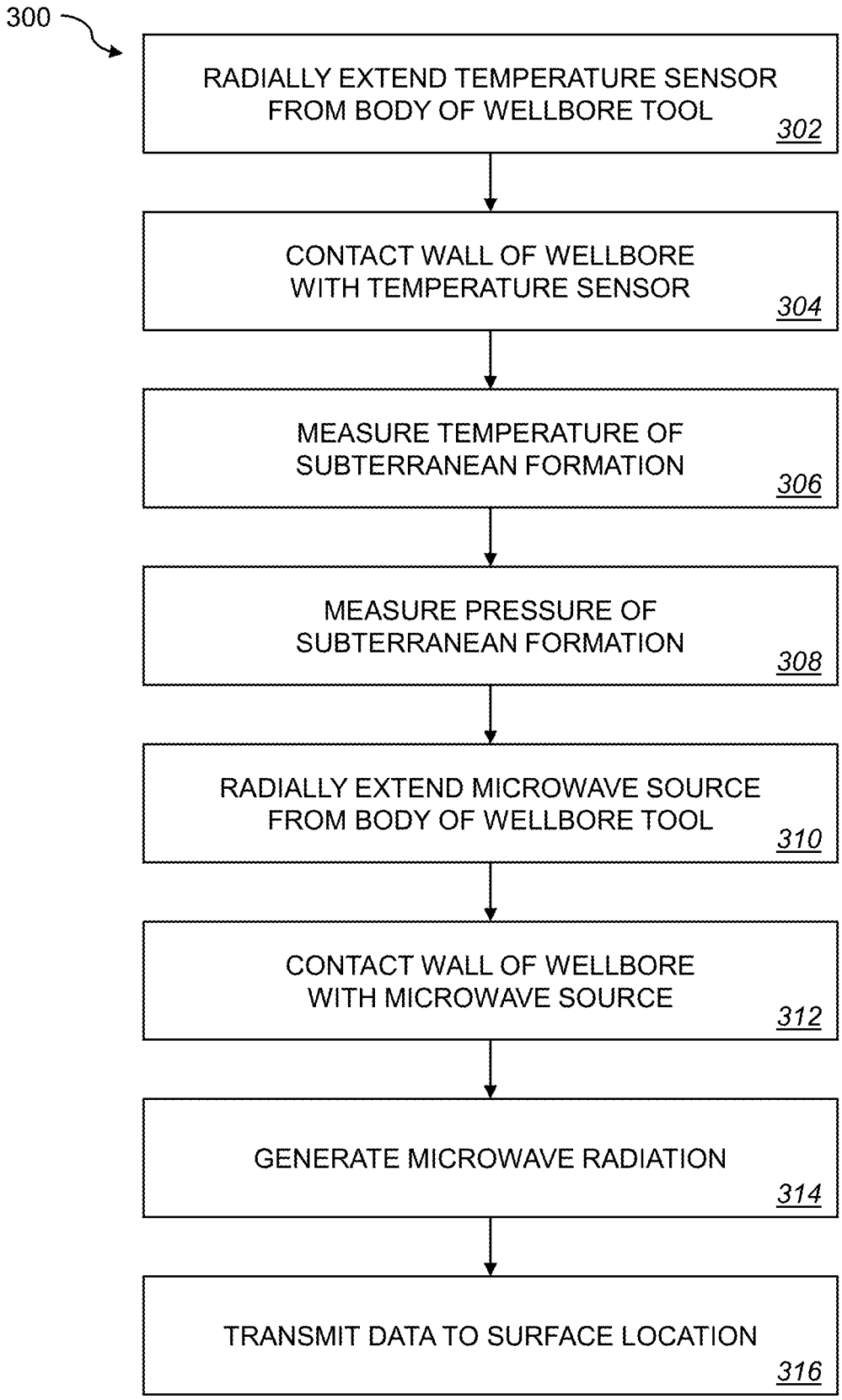

FIG. 2D is a side view of the FE tool 200 with its microwave source 216 generating microwave radiation within a well (for example, the well 100) to generate heat. Once the microwave source 216 is in contact with a wall of the wellbore, the microwave source 216 can begin to generate microwave radiation. The microwave radiation penetrates through the subterranean formation and begins to heat the subterranean formation itself, the fluid within the subterranean formation (for example, water), or both. The bolded arrow represents a focused generation of microwave radiation penetrating through the subterranean formation. The remaining arrows represent heat transfer distribution as a result of the focused generation of microwave radiation.

In some implementations, the microwave source 216 continuously generates microwave radiation until a threshold temperature is reached. In some implementations, the microwave source 216 intermittently generates microwave radiation (for example, in pulses). Throughout the microwave heat generating process and for a time period after the microwave heat stops being generated, the temperature sensor(s) 212 and the pressure sensor(s) 214 measure temperature and pressure, respectively. The gathered transient temperature and pressure data can be processed to determine one or more characteristics of the subterranean formation (for example, permeability and wettability), one or more characteristics of the fluid within the subterranean formation (for example, composition and salinity), or both.

FIG. 3 is a flow chart of an example method 300 for formation evaluation and reservoir characterization by using targeted heating in a well (for example, the well of FIG. 1). The method 300 can be implemented by the FE tool 200. The FE tool 200 can be disposed at a desired depth within a wellbore formed in a subterranean formation (for example, the wellbore of FIG. 1). At step 302, a temperature sensor (for example, the temperature sensor 212) is radially extended from the body of the FE tool 200. The temperature sensor 212 can be extended at step 302 by moving a moveable arm (for example, the moveable arm 210*a*) with an actuator (for example, the actuator 210*c*). The actuator 210*c* can be controlled by a computer (for example, the computer 500) to move the moveable arm 210*a*, thereby radially extending the temperature sensor 212 at step 302.

At step 304, a wall of the wellbore is contacted with the temperature sensor 214. In some implementations, a force on the temperature sensor 212 is measured at step 304. Measuring the force on the temperature sensor 212 can help verify whether the temperature sensor 212 is in contact with the wall of the wellbore at step 304.

At step 306, a temperature of the subterranean formation is measured by the temperature sensor 212.

At step 308, a pressure of the subterranean formation is measured by a pressure sensor of the wellbore tool (for example, the pressure sensor 214 of the FE tool 200). In some implementations, the pressure sensor 214 is radially extended from the body of the FE tool 200. The pressure sensor 214 can be extended by moving a moveable arm (for example, the moveable arm 210*a*) with an actuator (for example, the actuator 210*c*). The actuator 210*c* can be controlled by a computer (for example, the computer 500) to move the moveable arm 210*a*, thereby radially extending the pressure sensor 214.

At step 310, a microwave source (for example, the microwave source 216) is radially extended from the body of the wellbore tool (200). The microwave source 216 can be extended at step 310 by moving a moveable arm (for example, the moveable arm 210*a*) with an actuator (for example, the actuator 210*c*). The actuator 210*c* can be controlled by a computer (for example, the computer 500) to move the moveable arm 210*a*, thereby radially extending the microwave source 216 at step 310.

At step 312, the wall of the wellbore is contacted with the microwave source 216. In some implementations, a force on the microwave source 216 is measured at step 312. Measuring the force on the microwave source 216 can help verify whether the microwave source 216 is in contact with the wall of the wellbore at step 312.

At step 314, microwave radiation is generated by the microwave source 216 within the wellbore. In some implementations, the microwave radiation generated by the microwave source 216 is continually generated at step 312 until a threshold temperature is reached. The threshold temperature is less than the cracking temperature of crude oil. In some implementations, the microwave radiation generated by the microwave source 216 is intermittently generated at step 312 (for example, pulses) until the threshold temperature is reached.

At step 316, data corresponding to the measured temperature (at step 306), the measured pressure (at step 308), or both the measured temperature and the measured pressure is transmitted to a surface location external to the wellbore (for example, the surface 106).

Figure 4A:
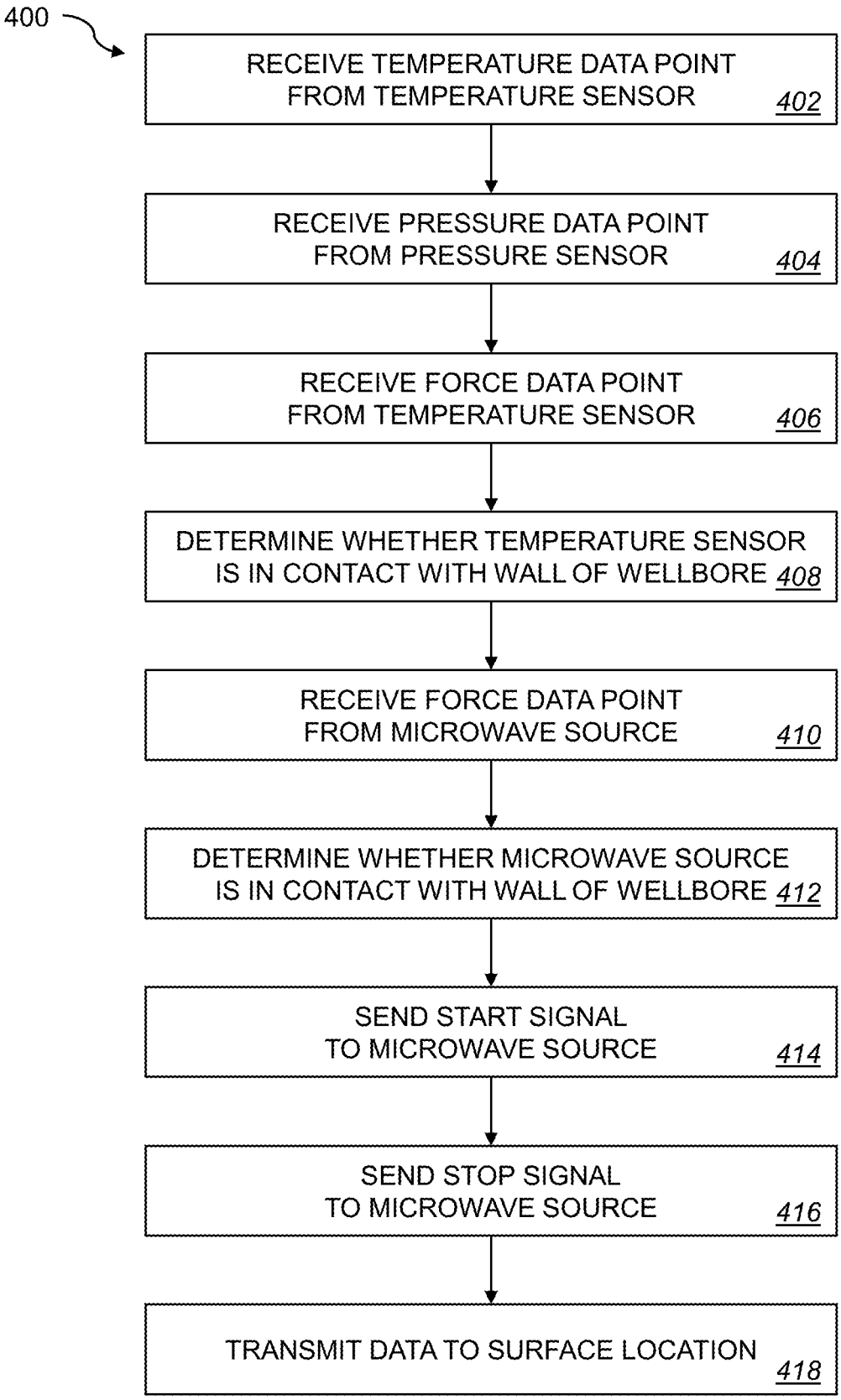
FIG. 4A is a flow chart of an example computer-implemented method for formation evaluation and reservoir characterization in the well of FIG. 1.

FIG. 4A is a flow chart of an example computer-implemented method 400 for monitoring the well 100 of FIG. 1. The method 400 can be implemented by the computer 500. At step 402, a temperature data point is received from a temperature sensor (for example, the temperature sensor 212) disposed within a wellbore formed in a subterranean formation (for example, the wellbore of FIG. 1).

At step 404, a pressure data point is received from a pressure sensor (for example, the pressure sensor 214) disposed within the wellbore.

At step 406, a force data point is received from the temperature sensor 212.

At step 408, it is determined whether the temperature sensor 212 is in contact with a wall of the wellbore based on the force data point received from the temperature sensor 212 at step 406.

In some implementations, a force data point is received from the pressure sensor 214, and it is determined whether the pressure sensor 214 is in contact with the wall of the wellbore based on the force data point received from the pressure sensor 214.

At step 410, a force data point is received from a microwave source (for example, the microwave source 216) disposed within the wellbore.

At step 412, it is determined whether the microwave source 216 is in contact with the wall of the wellbore based on the force data point received from the microwave source 216 at step 410.

At step 414, a start signal is sent to the microwave source 216 to begin generating microwave radiation after determining that the microwave source 216 is in contact with the wall of the wellbore at step 412.

At step 416, a stop signal is sent to the microwave source 216 to cease generating microwave radiation. In some implementations, the stop signal is sent at step 416 after determining that a temperature measured by the temperature sensor 212 is substantially equal to a threshold temperature based on the temperature data point received from the temperature sensor 212 at step 402. In some implementations, the method 400 alternates between steps 414 and 416 (generating pulses of microwave radiation).

At step 418, the received temperature data point (step 402), the received pressure data point (step 404), or both of the received temperature data point and the received pressure data point are transmitted to a surface location external to the wellbore (for example, the surface 106).

Figure 4B:
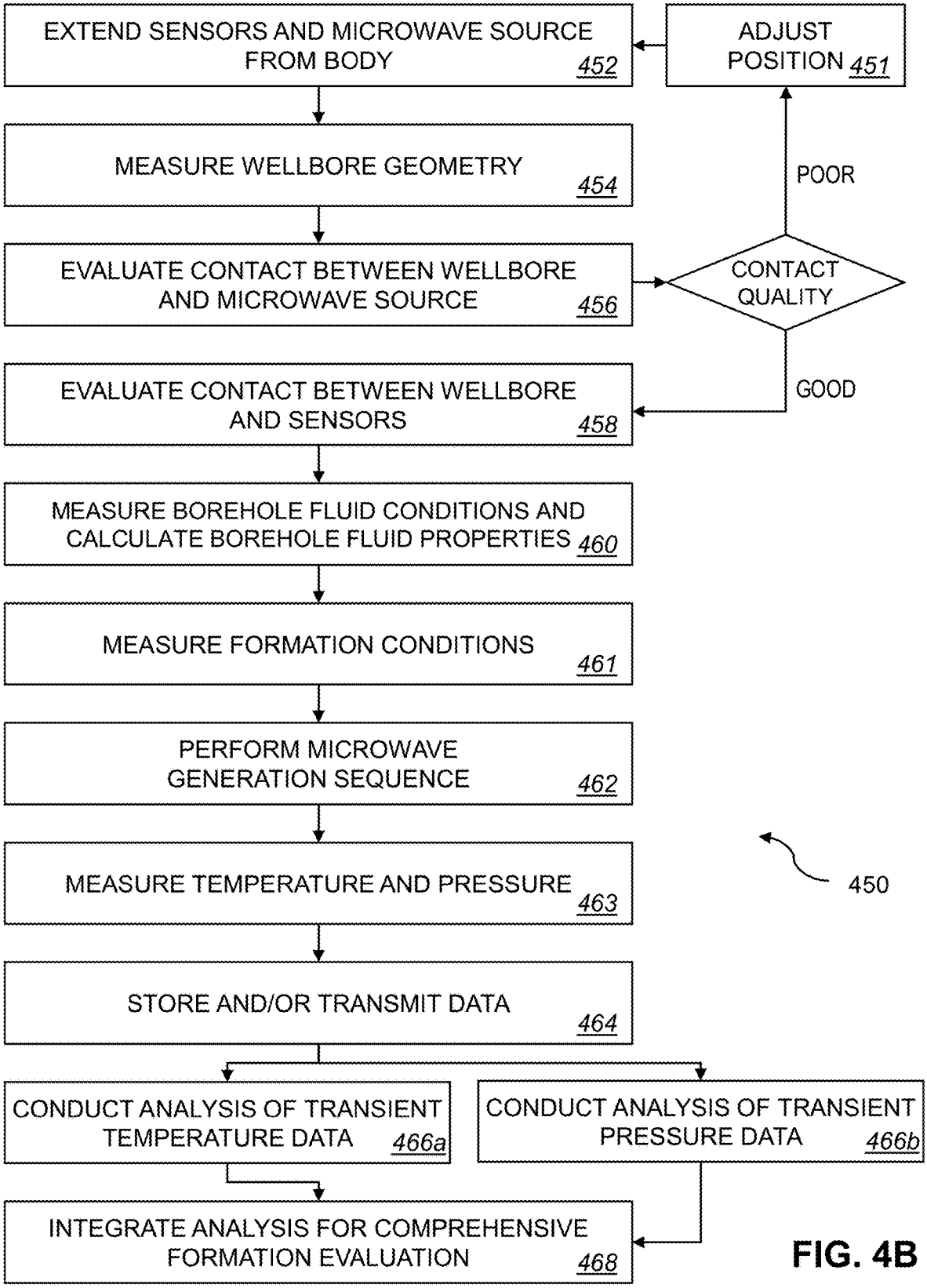
FIG. 4B is a flow chart of an example method for using the formation evaluation tool of FIG. 2A-3.

FIG. 4B is a flow chart of an example method 450 for formation evaluation and reservoir characterization by using targeted heating in a well (for example, the well of FIG. 1). The method 450 can be implemented by the FE tool 200. At step 452, sensors (for example, the temperature sensor(s) 212 and the pressure sensor(s) 214) and a microwave source (for example, the microwave source 216) are extended radially from the body of the FE tool 200. The sensors (212, 214) and the microwave source 216 can be extended at step 452 by actuators 210*c*. The actuators 210*c* can move moveable arms 210*a* to cause housings 210*b* (upon which the sensors 212 and 214 and the microwave source 216 are disposed) to extend radially from the body of the FE tool 200 at step 452.

At step 454, a geometry of the wellbore is measured. The geometry of the wellbore can be measured at step 454 by detecting the extent of protrusions of the housings 210*b* from the body of the FE tool 200. The geometry of the wellbore can be measured at step 454 by detecting the amount of force exerted by the wellbore wall onto the housings 210*b* (or the sensors 212, 214 and the microwave source 216).

At step 456, contact between the wellbore wall and the microwave source 216 is evaluated. If it is determined that the contact between the wellbore wall and the microwave source 216 is poor (for example, detection of low force exerted by the wellbore wall onto the microwave source 216), then the method proceeds to step 451 in which the position of the FE tool 200 is adjusted. Adjusting the position of the FE tool 200 at step 451 can include retracting the sensors (212, 214) and the microwave source 216 back toward the body of the FE tool 200 and then rotating the FE tool 200, moving the FE tool 200 to another location within the wellbore, or both. The method then returns to step 452.

If it is determined that the contact between the wellbore wall and the microwave source 216 is acceptable, then the method proceeds to step 458. At step 458, contact between the wellbore wall and the sensors (212, 214) is evaluated. If at step 458, it is determined that contact between one or more of the sensors (212, 214) and the wellbore wall is poor, then data collected from those sensors (at step 464) can be disregarded and omitted from analysis (at step 466).

At step 460, borehole fluid conditions (for example, temperature and pressure) are measured (for example, by the borehole fluid sensor 250). At step 460, borehole fluid properties are calculated based on the measured borehole fluid conditions. For example, fluid density can be determined by measuring a pressure gradient of the borehole fluid within the wellbore.

At step 461, formation conditions (for example, temperature and pressure) are measured (for example, by the temperature sensors 212 and pressure sensors 214).

At step 462, a microwave radiation generation sequence is performed. Microwave radiation can be generated, for example, by the microwave source 216. In some implementations, the microwave radiation generation sequence includes a constant generation of microwave radiation. In some implementations, the microwave radiation generation sequence includes an intermittent generation (for example, pulsing) of microwave radiation. The microwave radiation generation sequence can be performed until a threshold temperature is reached in the subterranean formation in response to the generated microwave radiation.

At step 463, temperature and pressure are measured (for example, by temperature sensors 212 and pressure sensors 214, respectively). Temperature and pressure can be recorded measured step 462, during step 462, and after step 462. The temperature measured at step 463 can be used to determine when microwave radiation generation at step 462 ceases. Temperature and pressure can be measured repeatedly at step 463.

At step 464, the temperatures and pressures measured at step 463 are stored (for example, in the memory of the computer system 500), transmitted to a surface location external to the wellbore (for example, the surface 106), or both. The temperatures and pressures can be associated with time instances, such that the temperatures and pressures are recorded as transient temperature data and transient pressure data, respectively.

At steps 466*a* and 466*b*, an analysis of the transient data is conducted. The analysis at step 466*a* includes an analysis of the transient temperature data. Temperature related formation properties can be calculated from analyzing the transient temperature data at step 466*a*. The analysis at step 466*b* includes an analysis of the transient pressure data. Pressure related formation properties can be calculated from analyzing the transient pressure data at step 466*b*. In some implementations, formation properties can be calculated from analyzing the transient temperature data and the transient pressure data together.

At step 468, the analyses conducted at steps 466*a* and 466*b* are integrated for a comprehensive formation evaluation of the subterranean formation. For example, the findings from the analyses conducted at steps 466*a* and 466*b* can be integrated with other data obtained about the subterranean formation (for example, from drilling and sampling).

One or more of the steps of method 300, method 400, or method 450 can occur simultaneously. One or more of the steps of method 300, method 400, or method 450 can be repeated. As one example, step 306 can be repeated throughout implementation of method 300 and during any of the other steps of method 300. As another example, step 402 can be repeated throughout implementation of method 400 and during any of the other steps of method 400. In some implementations, step 306 is repeated for a time period after microwave generation at step 314 has ceased (cooling phase). In some implementations, step 402 is repeated for a time period after step 416. In implementations where any of the steps of method 300 are repeated, step 316 can include transmitting a set of data obtained throughout the method 300. In implementations where any of the steps of method 400 are repeated, step 418 can include transmitting a set of data obtained throughout the method 400.

Figure 5:
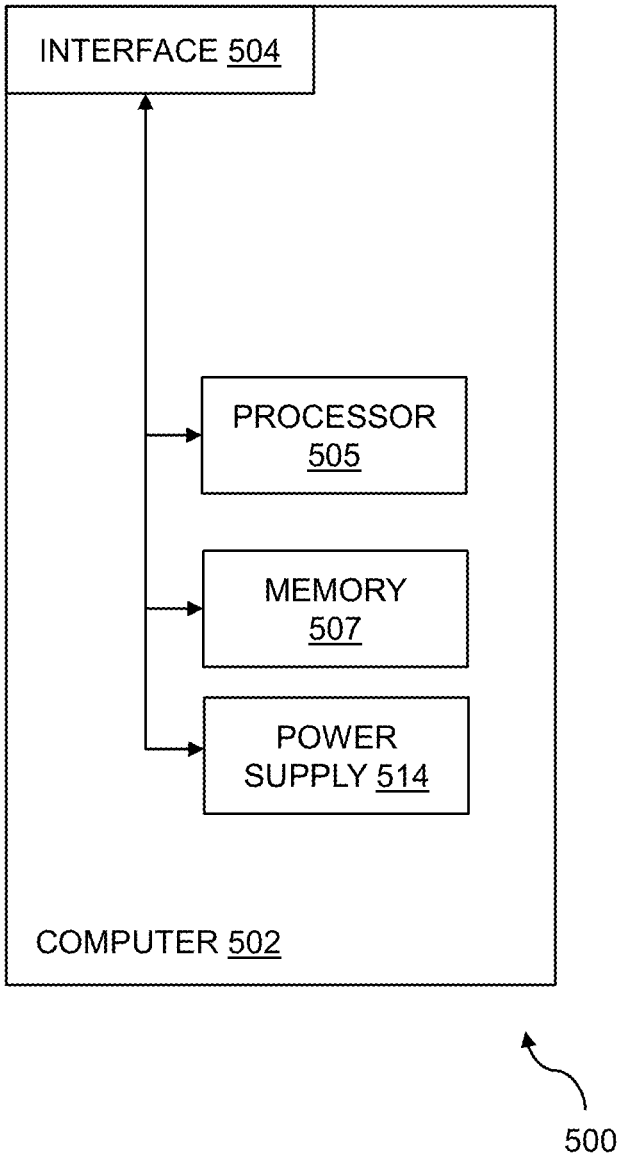
FIG. 5 is a block diagram of an example computer system.

FIG. 5 is a block diagram of an example computer system 500 used to provide computational functionalities associated with described algorithms, methods, functions, processes, flows, and procedures, as described in this specification, according to an implementation. As mentioned previously, in some implementations, the FE tool 200 includes the computer system 500. In some implementations, the computer system 500 is not included within the FE tool 200 itself, but is instead provided external to the FE tool 200 (for example, at the surface 106) and connected to the FE tool 200.

The illustrated computer 502 is intended to encompass any computing device such as a server, desktop computer, laptop/notebook computer, one or more processors within these devices, or any other suitable processing device, including physical or virtual instances (or both) of the computing device. Additionally, the computer 502 can include a computer that includes an input device, such as a keypad, keyboard, touch screen, or other device that can accept user information, and an output device that conveys information associated with the operation of the computer 502, including digital data, visual, audio information, or a combination of information.

The computer 502 includes a processor 505. Although illustrated as a single processor 505 in FIG. 5, two or more processors may be used according to particular needs, desires, or particular implementations of the computer 502. Generally, the processor 505 executes instructions and manipulates data to perform the operations of the computer 502 and any algorithms, methods, functions, processes, flows, and procedures as described in this specification.

The computer 502 includes a memory 507 that can hold data for the computer 502 or other components (or a combination of both) that can be connected to the network. Although illustrated as a single memory 507 in FIG. 5, two or more memories 507 (of the same or combination of types) can be used according to particular needs, desires, or particular implementations of the computer 502 and the described functionality. While memory 507 is illustrated as an integral component of the computer 502, memory 507 can be external to the computer 502. The memory 507 can be a transitory or non-transitory storage medium.

The memory 507 stores computer-readable instructions executable by the processor 505 that, when executed, cause the processor 505 to perform operations, such as transmitting a signal to an actuator (for example, the actuator 210*c*) to move a respective moveable arm (for example, the moveable arm 210*a*). The computer 502 can also include a power supply 514. The power supply 514 can include a rechargeable or non-rechargeable battery that can be configured to be either user- or non-user-replaceable. The power supply 514 can be hard-wired. There may be any number of computers 502 associated with, or external to, a computer system containing computer 502, each computer 502 communicating over the network. Further, the term "client," "user," "operator," and other appropriate terminology may be used interchangeably, as appropriate, without departing from this specification. Moreover, this specification contemplates that many users may use one computer 502, or that one user may use multiple computers 502.

In some implementations, the computer 502 includes an interface 504. Although not shown in FIG. 5, the computer 502 can be communicably coupled with a network. The interface can be used by the computer 502 for communicating with other systems that are connected to the network in a distributed environment.

In some implementations, the computer 502 includes a database that can hold data for the computer 502 or other components (or a combination of both) that can be connected to the network. The database can be an integral component of the computer 502 or external to the computer 502.

EXAMPLES

Figure 6A:
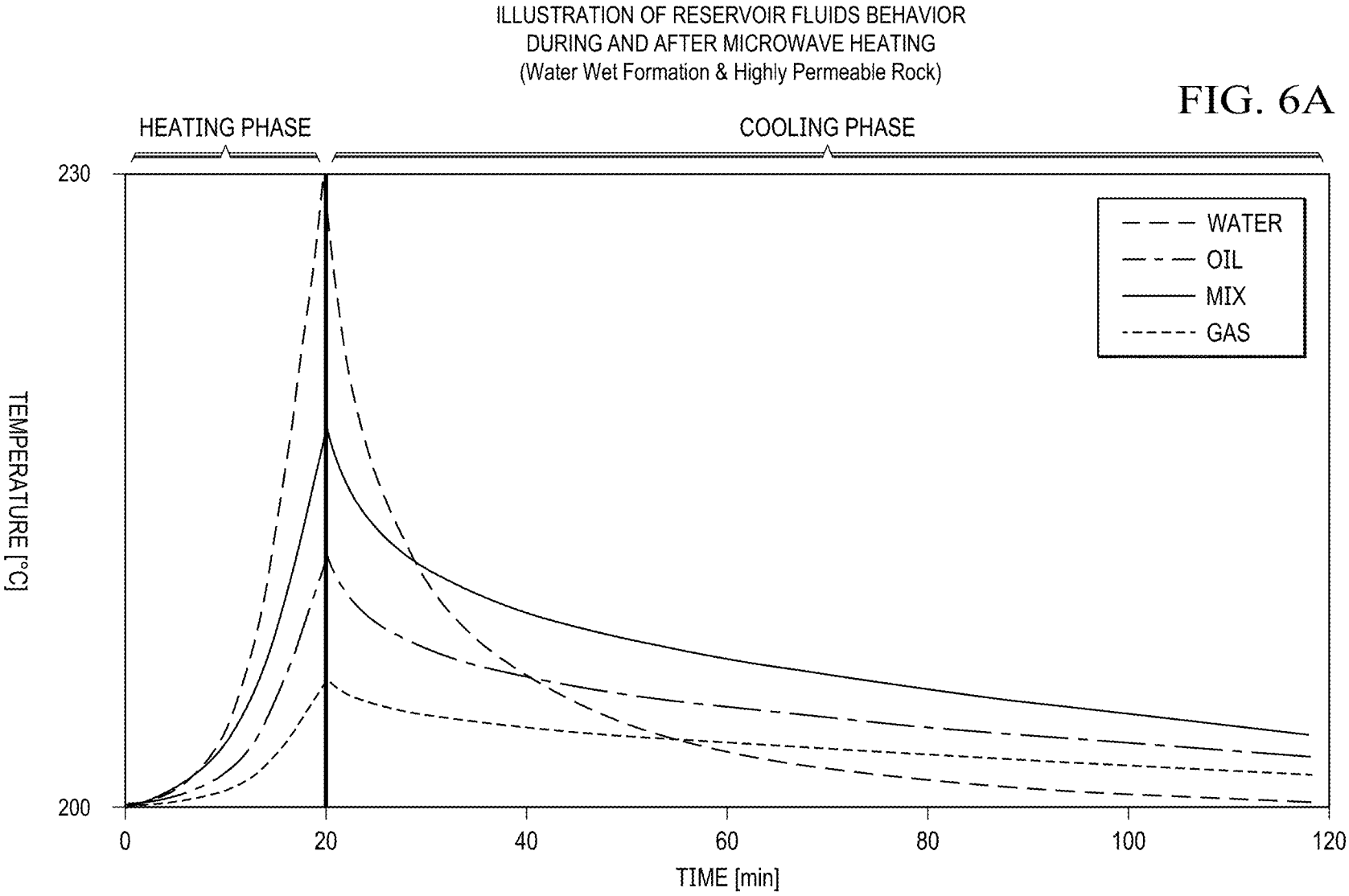
FIG. 6A is an illustrative plot of transient temperature data for various fluids during a heating phase and a cooling phase.

FIG. 6A is an illustrative plot of transient temperature data for various fluids during a heating phase and a cooling phase of a water-wet and highly permeable rock formation. The various curves, each attributed to one of the example fluids (water, oil, mixture of water and oil, and gas), demonstrate the differences in transient behavior of the various fluids in response to microwave heating. The heating phase corresponds to the time period during which microwave heat is generated within the subterranean formation. The cooling phase corresponds to the time period after microwave heat generation ceases, and the subterranean formation is allowed to cool. Transient temperature (and pressure) data is collected throughout both phases.

FIG. 6A shows that in this particular instance, the fluid in the rock both heated up and cooled down more rapidly than any of the other experimental runs when the rock was 100% water saturated. The fluid in the 100% water saturated rock also reached the greatest temperature (about 230° C.) in response to microwave heating. The fluid in the rock saturated with a 50%/50% mixture of oil and water reached the second greatest temperature (about 216° C.) in response to microwave heating, followed by the fluid in the rock that was 100% oil saturated (about 211° C.), and followed by the fluid in the rock that was 100% gas saturated (about 206° C.). This behavior is expected, as water is polar and exhibits greater thermal conductivity in comparison to hydrocarbons. Consequently, the rate of heating and cooling (as well as maximum temperature reached upon heating) can be used to determine fluid characteristics. The rock that was 100% water saturated proved to be the best heat conductor, while the rock that was 100% gas saturated proved to be the worst heat conductor.

Figure 6B:
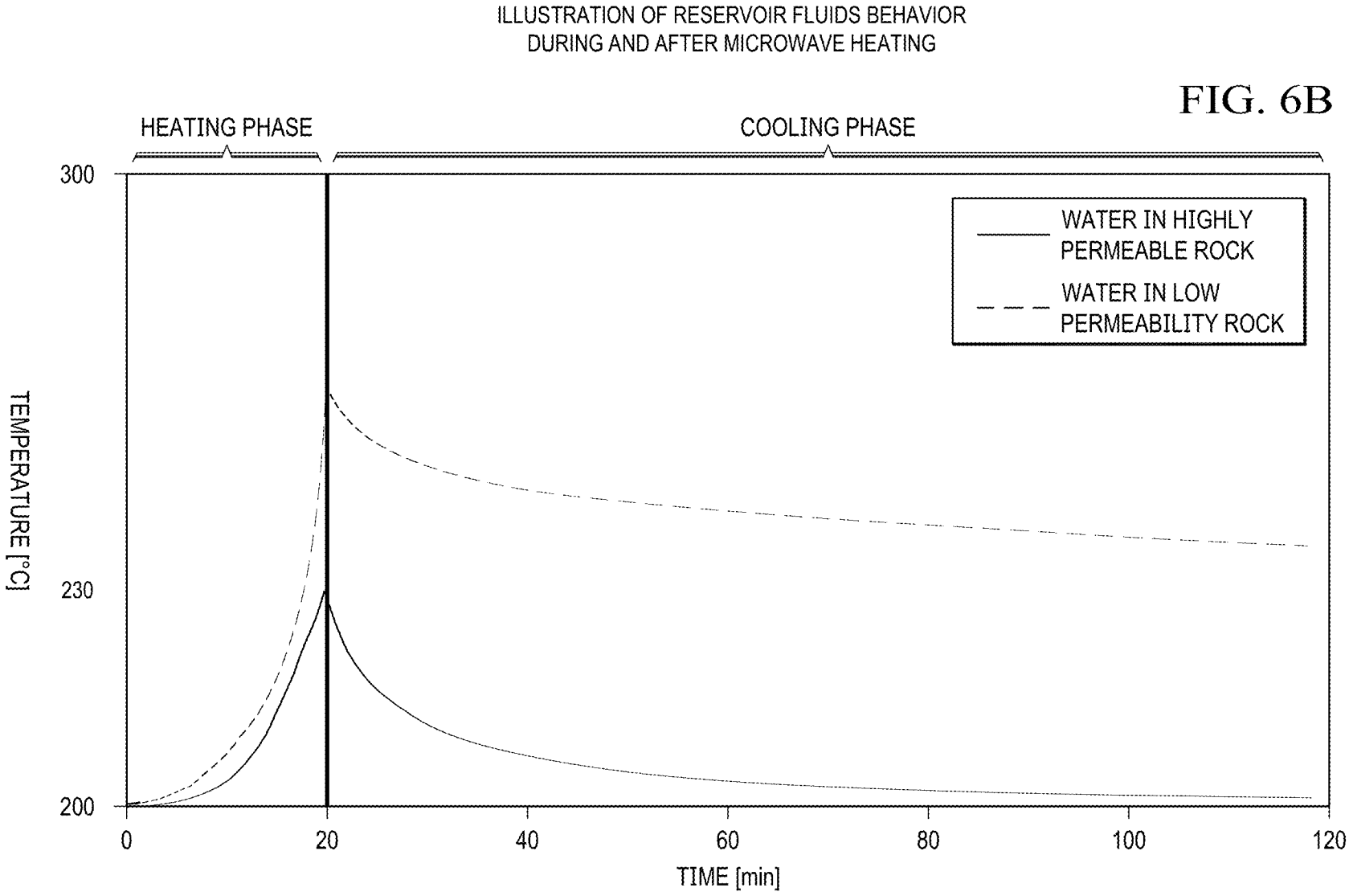
FIG. 6B is an illustrative plot of transient temperature data for water in rock formations with different permeabilities.

FIG. 6B is an illustrative plot of transient temperature data for water in rock formations with different permeabilities. For both cases (high and low permeabilities), the porosity of the rock formations and the salinity of the water were assumed to be the same, and the rock formations were assumed to be at 100% water saturation. The curves demonstrate the differences in transient behavior of rocks with varying permeabilities in response to microwave heating. The heating phase corresponds to the time period during which microwave heat is generated within the subterranean formation. The cooling phase corresponds to the time period after microwave heat generation ceases, and the subterranean formation is allowed to cool. Transient temperature (and pressure) data is collected throughout both phases. For both curves in FIG. 6B, water was used as the fluid being tested.

FIG. 6B shows that in this particular instance, the water in the low permeability rock heated up more quickly and reached a hotter temperature than the water in high permeability rock for the heating phase. In the cooling phase, the water in high permeability rock cooled down more quickly and returned to a cooler temperature than the water in low permeability rock. Permeability can generally correlate with the number of available conductive paths in a rock formation and can also generally correlate with heat conductivity of the rock formation. Rock formations with less permeability can tend to trap and accumulate heat in comparison to rock formations with greater permeability. This explains the quicker rate of heating in the heating phase and the slower rate of cooling in the cooling phase exhibited by the rock with lower permeability. Various permeabilities (for example, horizontal and vertical) of a rock formation can be determined based on the distribution of temperature sensing subsystems 210 along the FE tool 200.

Figure 6C:
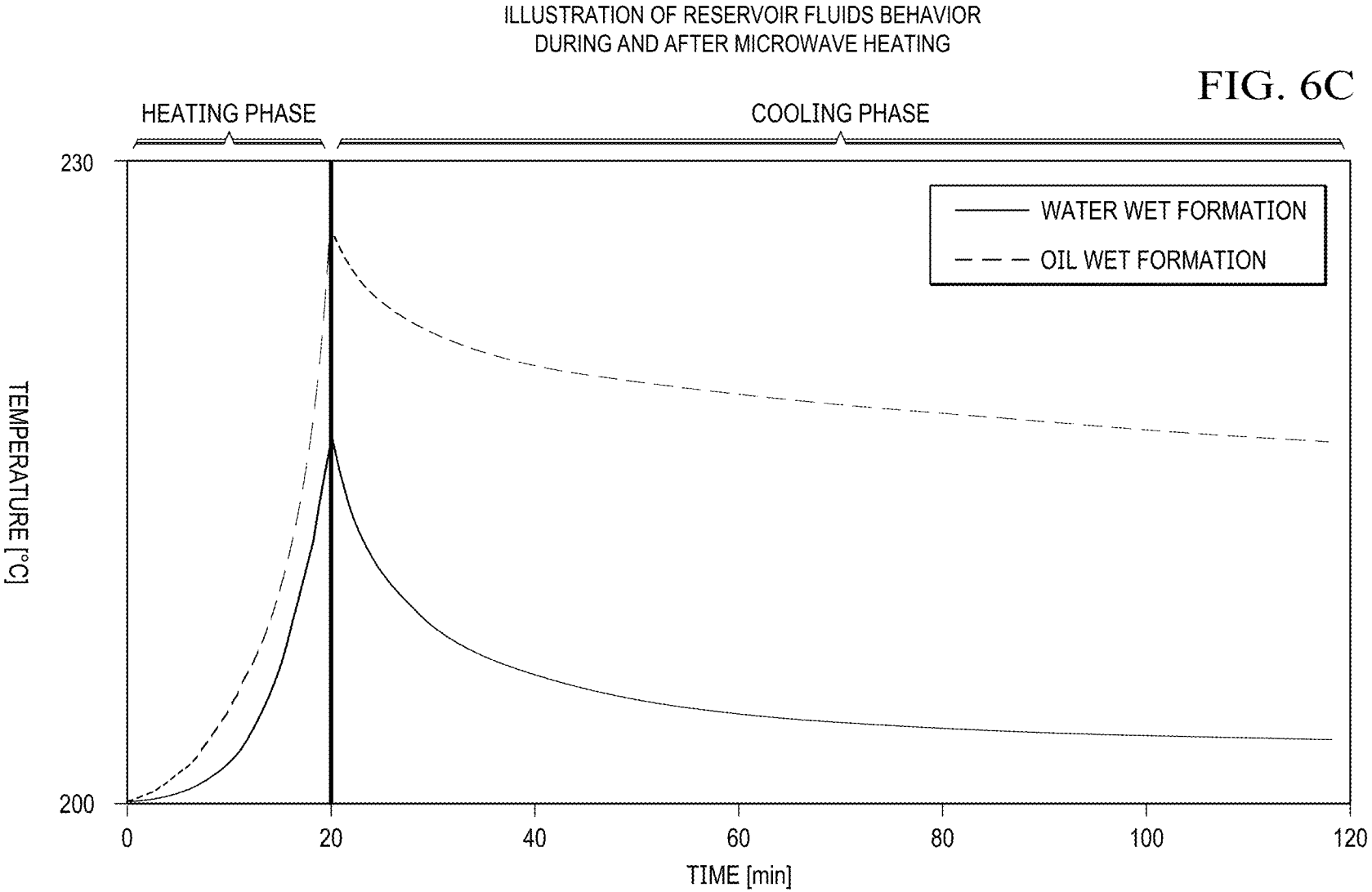
FIG. 6C is an illustrative plot of transient temperature data for water in rock formations with different wettabilities.

FIG. 6C is an illustrative plot of transient temperature data for water in rock formations with different wettabilities for a rock formation with high permeability. For both cases (water-wet and oil-wet), the porosity of the rock formations was assumed to be the same, and the rock formations were assumed to be at 50% water saturation. The curves demonstrate the differences in transient behavior of rocks with varying wettabilities in response to microwave heating. The heating phase corresponds to the time period during which microwave heat is generated within the subterranean formation. The cooling phase corresponds to the time period after microwave heat generation ceases, and the subterranean formation is allowed to cool. Transient temperature (and pressure) data is collected throughout both phases.

FIG. 6C shows that in this particular instance, the water in the oil-wet rock heated up more quickly and reached a hotter temperature than the water in water-wet rock for the heating phase. Similarly, in the cooling phase, the water in water-wet rock cooled down more quickly and returned to a cooler temperature than the water in oil-wet rock. Water-wet rocks can be expected to exhibit greater connectivity between water pathways in comparison to oil-wet rocks. This can be attributed to the greater tendency of water to be continuous in comparison to oil. Pathway connectivity (continuity) can generally correlate with heat conductivity.

Figure 6D:
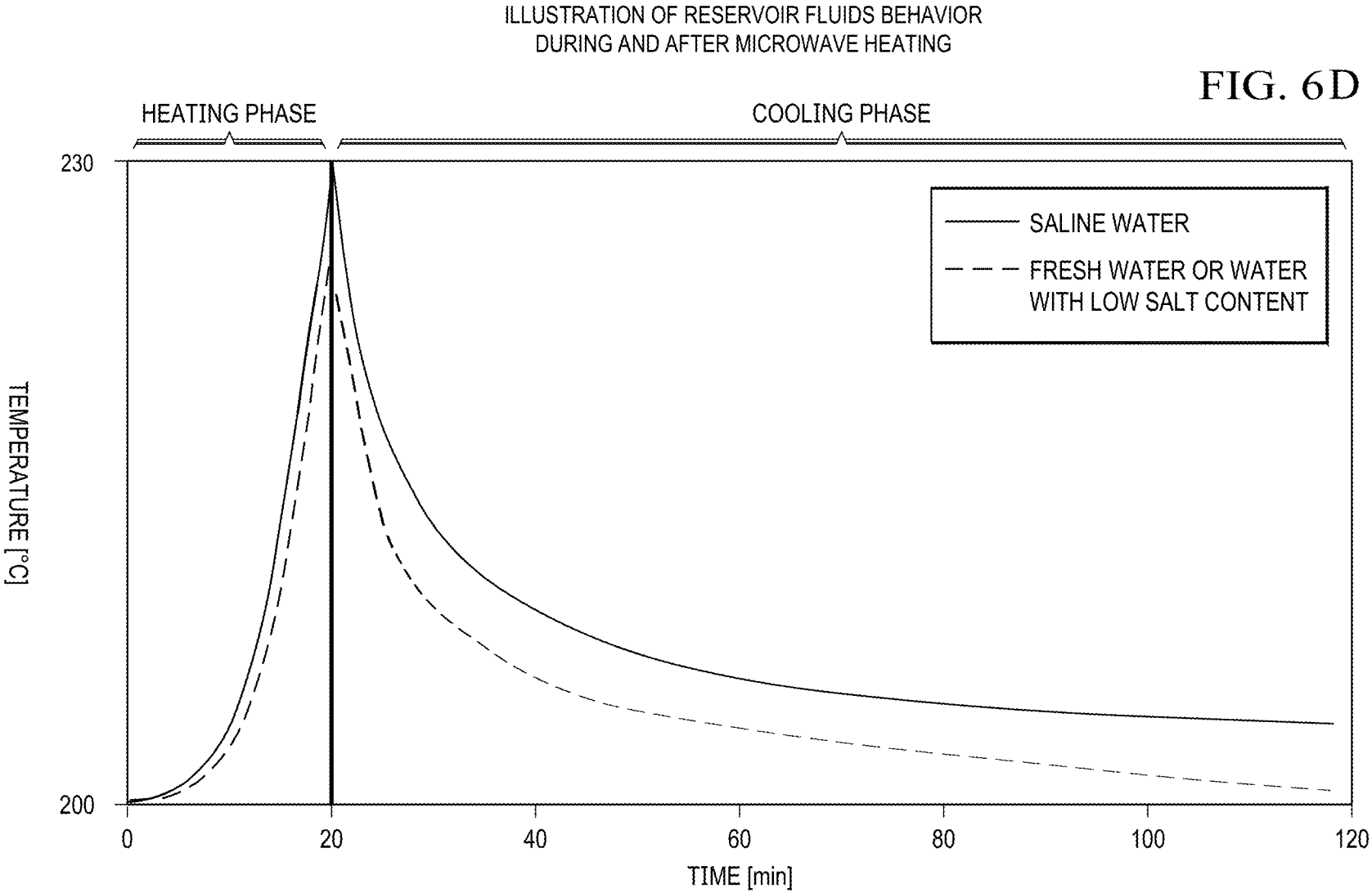
FIG. 6D is an illustrative plot of transient temperature data for water with different salinities in water-wet rock formations.

FIG. 6D is an illustrative plot of transient temperature data for water with different salinities in water-wet rock formations. For both cases (low and high salt content), the porosity and the permeability of the rock formations were assumed to be the same, and the rock formations were assumed to be at 100% water saturation. The curves demonstrate the differences in transient behavior of water with varying salt content in response to microwave heating. The heating phase corresponds to the time period during which microwave heat is generated within the subterranean formation. The cooling phase corresponds to the time period after microwave heat generation ceases, and the subterranean formation is allowed to cool. Transient temperature (and pressure) data is collected throughout both phases. For both curves in FIG. 6D, water (with varying salt content) was used as the fluid being tested.

FIG. 6D shows that in this particular instance, the high salinity water heated up slightly more quickly and reached a slightly hotter temperature than the low salinity water for the heating phase. However, in the cooling phase, the low salinity water cooled down more quickly and returned to a cooler temperature than the high salinity water. The increased temperature and heating rate of the high salinity water can be attributed to the increased motion of salt ions in response to the microwave energy. In contrast, the low salinity water proved to be a better heat conductor than the high salinity water based on low salinity water's ability to cool down more quickly and reach a cooler temperature in comparison to the high salinity water.

Figure 6E:
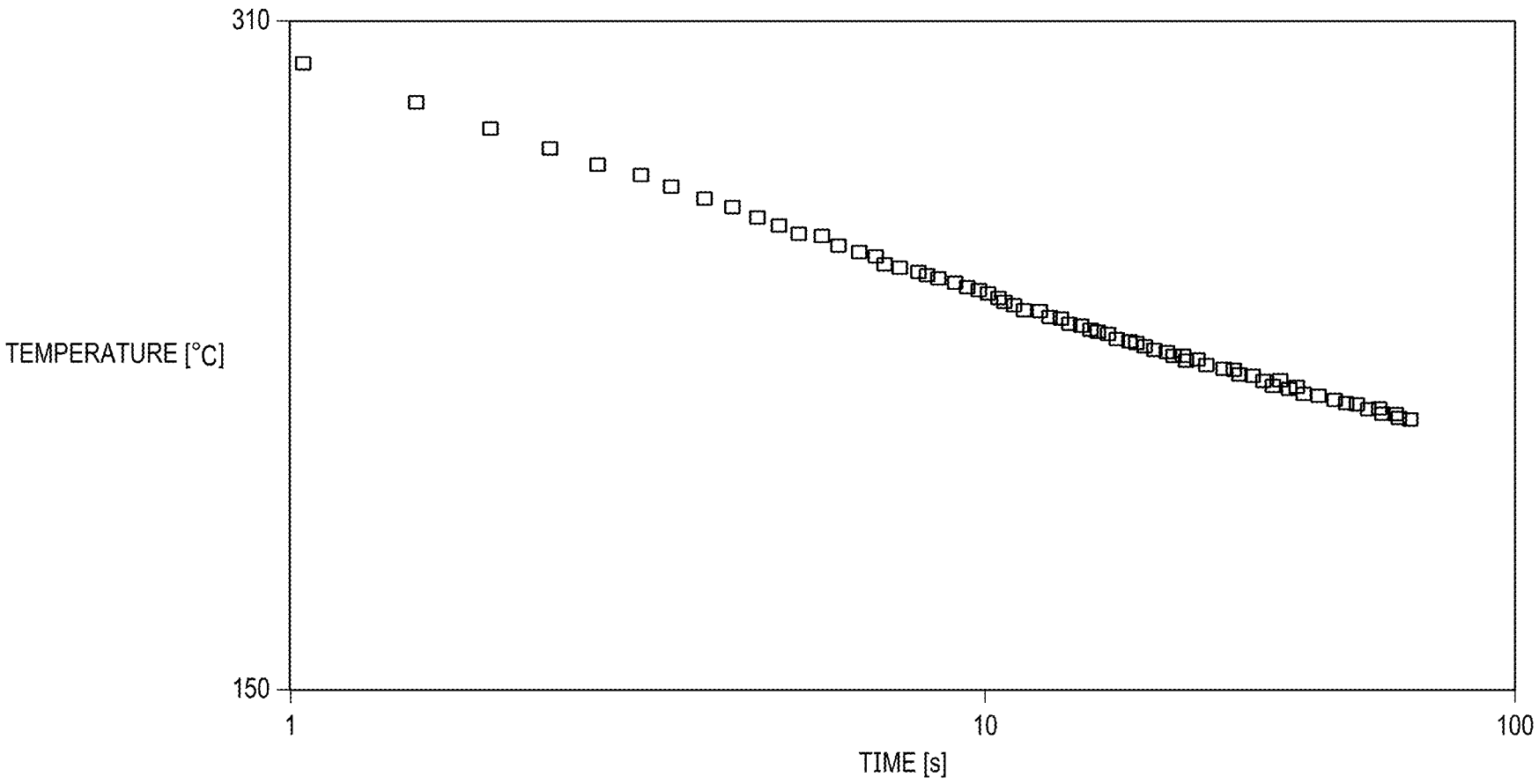
FIG. 6E is an illustrative plot of transient temperature data that can be used to determine formation thermal properties.

FIG. 6E is a semi-logarithmic plot of transient temperature data of a fluid in a rock formation during cooling. Thermal properties, such as thermal conductivity, can be calculated using the transient line heat source method. For example, in the case that the data is from a water zone with known rock porosity and permeability (for example, from an openhole log analysis), the slope of the data can indicate a level of salinity of the water. As another example, if water salinity is already known, the slope of the data can indicate a level of rock permeability. As another example, in the case that the data is from an oil zone with known rock porosity, permeability, and saturation, the slope of the data can indicate a level of wettability of the rock.

Figure 6F:
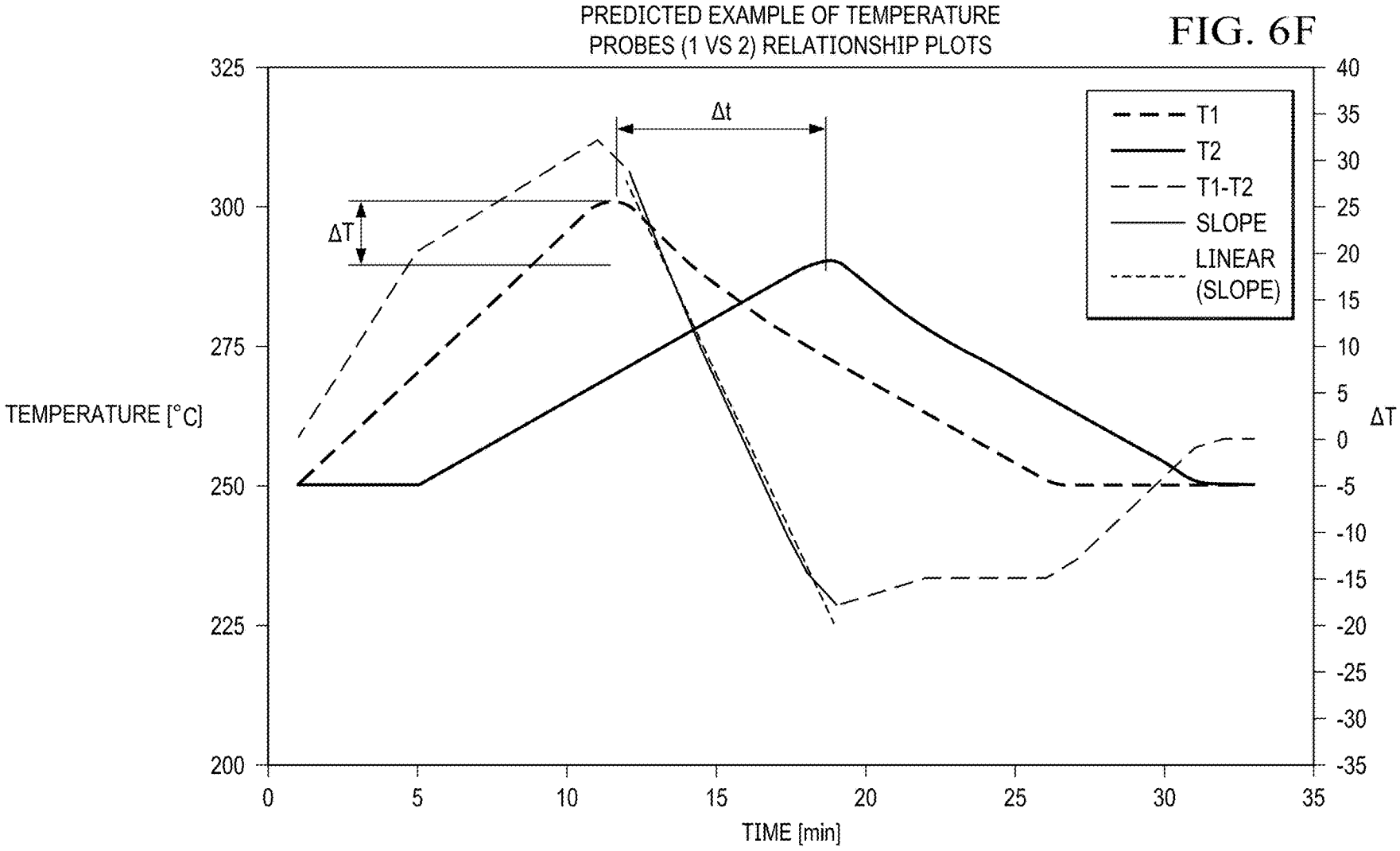
FIG. 6F is an illustrative plot of transient temperature data collected from two temperature sensors at different locations for determining various formation properties.

FIG. 6F is a plot of transient temperature data collected from two temperature sensors at different vertical locations. T1 is a first temperature sensor (212), and T2 is a second temperature sensor (212) located at different points (points ① and ② in FIG. 2D) along the body of the FE tool 200. ΔL was the distance between the two temperature sensors (T1 and T2). There are also two pressure sensors 214 (P1 and P2) at points ① and ② of FIG. 2D.

The difference in the maximum temperatures measured by T1 and T2 (ΔT, the reduction of amplitude of T2 in comparison to T1) may indicate an effective volume of fluids (related to rock porosity and saturation) conducting heat from sensor T1 to sensor T2. The time delay between the maximum temperatures measured by T1 and T2 (Δt, the lag of T2 measuring a max temperature in comparison to T1) may indicate a difference in heat conductivity (which is proportional to rock permeability and wettability) of the regions from T1 to T2.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A wellbore tool comprising:

a body having a longitudinal axis and an outer circumferential surface, the body configured to be disposed within a wellbore formed in a subterranean formation;

a plurality of moveable arms, at least a portion of each of the plurality of moveable arms positioned within the body, wherein each of the plurality of moveable arms are segmented into a first segment, a second segment, and a third segment and comprise:

a first joint coupling the first segment and the second segment;

a second joint coupling the second segment and the third segment; and a third joint coupling the third segment and the body, the third joint being fixed in location relative to the body;

a plurality of housings, each of the plurality of housings:

positioned external to the body; and coupled to the second joint of a respective one of the plurality of moveable arms;

a plurality of actuators, each of the plurality of actuators:

positioned within the body;

coupled to the first joint of a respective one of the plurality of moveable arms; and configured to move the respective one of the plurality of moveable arms, wherein the body defines a plurality of openings on the outer circumferential surface of the body, and each of the plurality of moveable arms are configured to move through a respective one of the plurality of openings in response to being moved by a respective one of the plurality of actuators;

a temperature sensor disposed on an outer surface of one of the plurality of housings, the temperature sensor configured to measure a temperature of the subterranean formation;

a pressure sensor disposed on an outer surface of one of the plurality of housings, the pressure sensor configured to measure a pressure of the subterranean formation; and a heat source disposed on an outer surface of one of the plurality of housings, the heat source configured to generate heat.

2. The wellbore tool of claim 1, comprising a computer positioned within the body, the computer configured to communicate with the temperature sensor, the pressure sensor, and the heat source, wherein the computer comprises:

a processor; and a computer-readable medium storing instructions executable by the processor to perform operations comprising:

sending a signal to a first actuator of the plurality of actuators to initiate movement of the respective one of the plurality of moveable arms to which the first actuator is coupled;

receiving temperature data from the temperature sensor;

receiving pressure data from the pressure sensor; and transmitting the received temperature data, the received pressure data, or both of the received temperature data and the received pressure data to a surface location via a wireline coupled to the body.

3. The wellbore tool of claim 2, wherein each of the plurality of actuators are configured to move the first segment of the respective one of the plurality of moveable arms in a direction parallel to the longitudinal axis of the body, and in response to the first segment moving in the direction parallel to the longitudinal axis of the body, the second segment, the third segment, the first joint, the second joint, and the third joint are cooperatively configured to move the respective one of the plurality of housings in a direction perpendicular to the longitudinal axis of the body.

4. The wellbore tool of claim 3, wherein the temperature sensor and the pressure sensor are disposed on the same one of the plurality of housings.

5. The wellbore tool of claim 4, wherein:

the temperature sensor is configured to contact a wall of the wellbore and measure a force exerted by the wall of the wellbore onto the temperature sensor during contact;

the pressure sensor is configured to contact the wall of the wellbore and measure a force exerted by the wall of the wellbore onto the pressure sensor during contact; and the heat source is a microwave source configured to contact the wall of the wellbore and measure a force exerted by the wall of the wellbore onto the microwave source during contact.

6. The wellbore tool of claim 5, wherein the temperature sensor is a first temperature sensor of a plurality of temperature sensors, and each of the plurality of temperature sensors are disposed on a different one of plurality of housings.

7. The wellbore tool of claim 6, wherein the pressure sensor is a first pressure sensor of a plurality of pressure sensors, and each of the plurality of pressure sensors are disposed on a different one of the plurality of housings.

8. The wellbore tool of claim 7, wherein the first temperature sensor, the first pressure sensor, and the microwave source are disposed on the same one of plurality of housings.

9. A method comprising:

radially extending a temperature sensor from a body of a wellbore tool disposed within a wellbore formed in a subterranean formation;

contacting a wall of the wellbore with the temperature sensor;

measuring, by the temperature sensor, a temperature of the subterranean formation;

measuring, by a pressure sensor of the wellbore tool, a pressure of the subterranean formation;

radially extending a microwave source from the body of the wellbore tool;

contacting the wall of the wellbore with the microwave source;

generating, by the microwave source, microwave radiation within the wellbore, wherein generating microwave radiation occurs after contacting the wall of the wellbore with the microwave source, and generating microwave radiation by the microwave source occurs until the measured temperature is substantially equal to a threshold temperature, after which generating microwave radiation ceases; and transmitting data corresponding to the measured temperature, the measured pressure, or both the measured temperature and the measured pressure to a surface location external to the wellbore.

10. The method of claim 9, comprising centralizing the body of the wellbore tool within the wellbore by radially extending a plurality of temperature sensors and a plurality of pressure sensors from the body of the wellbore tool and contacting the wall of the wellbore with the plurality of temperature sensors and the plurality of pressure sensors.

11. The method of claim 10, wherein measuring the temperature of the subterranean formation continues during generation of microwave radiation and for a time period after the generation of microwave radiation ceases.

12. The method of claim 11, wherein measuring the pressure of the subterranean formation continues during generation of microwave radiation and for the time period after the generation of microwave radiation ceases.

13. A computer-implemented method comprising:

receiving a temperature data point from a temperature sensor disposed within a wellbore formed in a subterranean formation;

receiving a pressure data point from a pressure sensor disposed within the wellbore;

receiving a force data point from the temperature sensor;

determining whether the temperature sensor is in contact with a wall of the wellbore based on the received force data point from the temperature sensor;

receiving a force data point from a microwave source disposed within the wellbore;

determining whether the microwave source is in contact with the wall of the wellbore based on the received force data point from the microwave source;

sending a start signal to the microwave source to begin generating microwave radiation after determining that the microwave source is in contact with the wall of the wellbore;

sending a stop signal to the microwave source to cease generating microwave radiation after determining that a temperature measured by the temperature sensor is substantially equal to a threshold temperature based on the received temperature data point;

transmitting the received temperature data point, the received pressure data point, or both of the received temperature data point and the received pressure data point to a surface location external to the wellbore.

14. The computer-implemented method of claim 13, comprising:

linking the received temperature data point and the received pressure data point to a time point;

repeating the steps of receiving temperature data, receiving pressure data, and linking the received temperature data point and the received pressure data point to the time point to generate a set of transient temperature data and a set of transient pressure data; and transmitting the set of transient temperature data, the set of transient pressure data, or both sets of transient temperature data and transient pressure data to the surface location external to the wellbore.

15. The computer-implemented method of claim 14, comprising determining at least one of a fluid composition, fluid density, fluid phase tortuosity, thermal conductivity, diffusivity, heat capacity, water saturation, water salinity, wettability, or permeability of the subterranean formation based on the set of transient temperature data, the set of transient pressure data, or both sets of transient temperature data and transient pressure data.

16. The computer-implemented method of claim 14, comprising sending an extend signal to an actuator coupled to a moveable arm coupled to a housing, thereby causing the actuator to extend the moveable arm to initiate contact between the housing and the wall of the wellbore, wherein the temperature sensor, the pressure sensor, and the microwave source are disposed on an outer surface of the housing.

17. The computer-implemented method of claim 16, comprising:

sending a retract signal to the actuator, thereby causing the actuator to retract the moveable arm to release contact between the housing and the wall of the wellbore.

* * * * *